US012234114B2

(12) United States Patent
Sugiyama

(10) Patent No.: US 12,234,114 B2
(45) Date of Patent: Feb. 25, 2025

(54) PRINTING APPARATUS, CONTROL METHOD OF PRINTING APPARATUS, AND STORAGE MEDIUM

(71) Applicant: CANON KABUSHIKI KAISHA, Tokyo (JP)

(72) Inventor: Noriyuki Sugiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 635 days.

(21) Appl. No.: 17/168,378

(22) Filed: Feb. 5, 2021

(65) Prior Publication Data

US 2021/0253382 A1 Aug. 19, 2021

(30) Foreign Application Priority Data

Feb. 19, 2020 (JP) ..... 2020-026170

(51) Int. Cl.
*B65H 3/06* (2006.01)

(52) U.S. Cl.
CPC ..... *B65H 3/0669* (2013.01); *B65H 3/0653* (2013.01)

(58) Field of Classification Search
CPC ..... B65H 3/06; B65H 3/0638; B65H 3/0661; B65H 3/0669; B65H 3/5215; B65H 3/5261; B65H 2301/531; B65H 2407/20; B65H 2511/417; B65H 2601/324
See application file for complete search history.

(56) References Cited

U.S. PATENT DOCUMENTS 3,951,264 A * 4/1976 Heidecker ..... G11B 23/0328 360/60
5,775,823 A 7/1998 Bekki et al.
7,165,765 B2 * 1/2007 Sonoda ..... B41J 13/26 271/125

(Continued)

FOREIGN PATENT DOCUMENTS

CN 1488562 A 4/2004
CN 101362561 A 2/2009

(Continued)

OTHER PUBLICATIONS

Office Action in Chinese Patent Application No. 202110184993.2, dated Mar. 30, 2023.

(Continued)

*Primary Examiner* — Prasad V Gokhale
(74) *Attorney, Agent, or Firm* — Venable LLP

(57) ABSTRACT

A printing apparatus, in which it is possible to easily clean the surface of a feeding roller and a separation roller by using a damp cloth or the like, includes a feeding roller that feeds a printing medium; a separation roller capable of selectively taking a state where a separating force that separates a plurality of printing media conveyed by the feeding roller one by one has occurred and a state where the separating force has not occurred at a position at which the separation roller is in pressure contact with the feeding roller; and a control unit configured to perform control to bring about a standby state where transmission of a driving force between a driving source of the feeding roller and the feeding roller is shut off in a state where the separating force has not occurred and the feeding roller and the separation roller abut each other.

18 Claims, 16 Drawing Sheets

C-C

(56) References Cited

U.S. PATENT DOCUMENTS

| | | | | |
|---|---|---|---|---|
| 7,802,934 | B2 | 9/2010 | Mushimoto | |
| 8,072,474 | B2 | 12/2011 | Nishimura et al. | |
| 8,360,415 | B1 | 1/2013 | Herrmann et al. | |
| 8,695,963 | B2 * | 4/2014 | Taniguchi | B65H 3/0661 271/265.01 |
| 10,616,427 | B2 | 4/2020 | Nomoto | |
| 11,214,454 | B2 | 1/2022 | Tajima et al. | |
| 2004/0041331 | A1 * | 3/2004 | Sonoda | B65H 9/20 271/121 |
| 2004/0070137 | A1 * | 4/2004 | Sonoda | B65H 3/0661 271/121 |
| 2015/0003860 | A1 * | 1/2015 | Shin | G03G 21/1638 399/98 |
| 2019/0193967 | A1 | 6/2019 | Shuto et al. | |

FOREIGN PATENT DOCUMENTS

| | | | |
|---|---|---|---|
| CN | 101564939 | A | 10/2009 |
| CN | 103253005 | A | 8/2013 |
| CN | 109573667 | A | 4/2019 |
| CN | 109956346 | A | 7/2019 |
| CN | 110784612 | A | 2/2020 |
| JP | 06-166446 | A | 6/1994 |
| JP | 07-215510 | A | 8/1995 |
| JP | 09-156789 | A | 6/1997 |
| JP | 11-334910 | A | 12/1999 |
| JP | 2002-308456 | A | 10/2002 |
| JP | 2004-010266 | A | 1/2004 |
| JP | 3871323 | B2 | 1/2007 |
| JP | 2007-063003 | A | 3/2007 |
| JP | 2007-276966 | A | 10/2007 |
| JP | 2007-331889 | A | 12/2007 |
| JP | 2009-040574 | A | 2/2009 |
| JP | 2009-263122 | A | 11/2009 |
| JP | 2017-214182 | A | 12/2017 |
| JP | 2018-131282 | A | 8/2018 |

OTHER PUBLICATIONS

Office Action dated Mar. 13, 2024, in Chinese Patent Application No. 202110184993.2.

Office Action dated Jan. 1, 2024, in Japanese Patent Application No. 2020-026170.

* cited by examiner

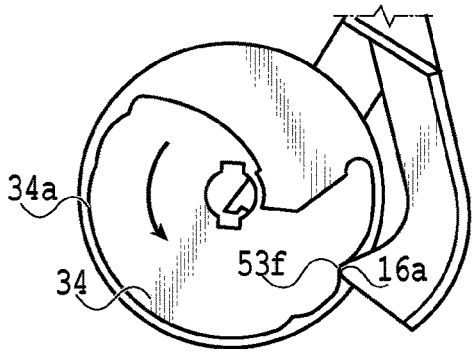
A-A
FIG.10A
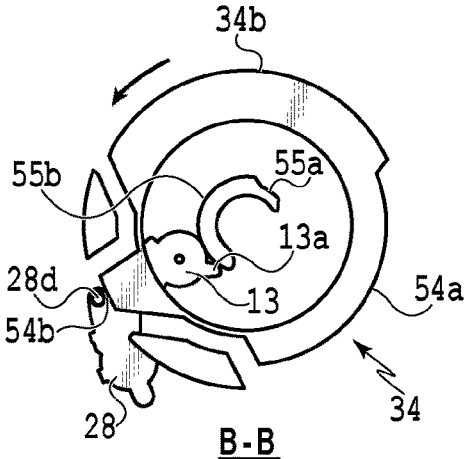
B-B
FIG.10B
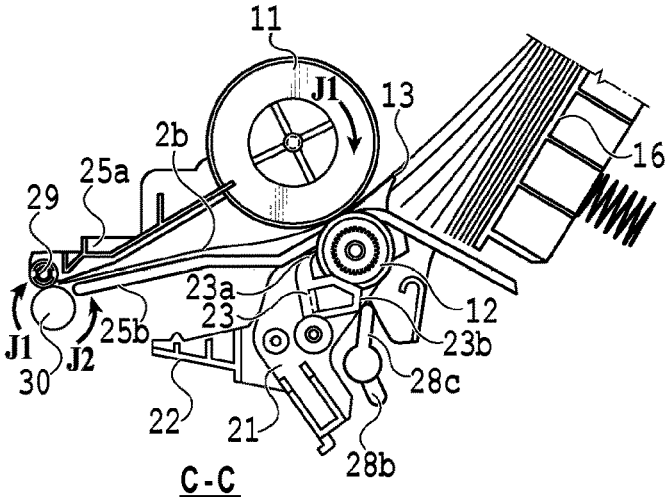
C-C
FIG.10C
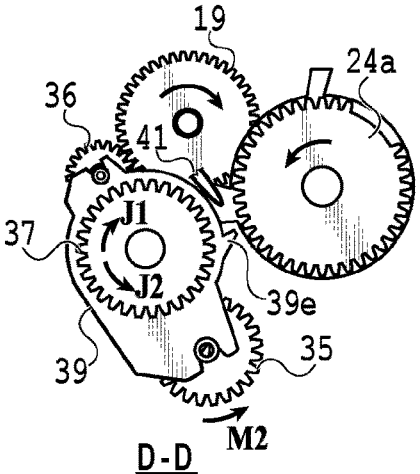
D-D
FIG.10D-1
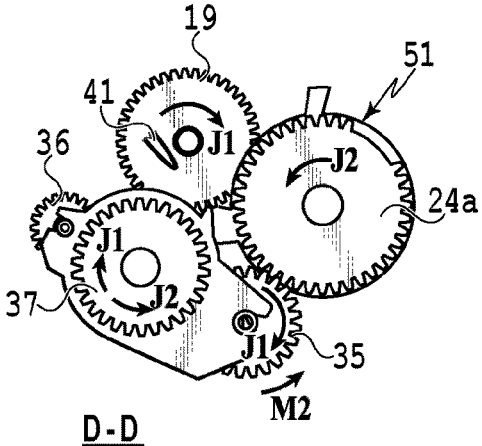
D-D
IG.10D-2
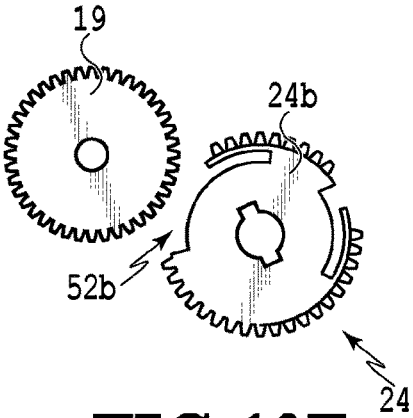
FIG.10E

PRINTING APPARATUS, CONTROL METHOD OF PRINTING APPARATUS, AND STORAGE MEDIUM

BACKGROUND OF THE INVENTION

Field of the Invention

The present disclosure relates to a printing apparatus that performs printing on a printing medium by a print head and in detail, relates to a printing apparatus having a feeding device that separates a sheet-shaped printing medium one by one from a plurality of stacked sheets and feeds the sheet.

Description of the Related Art

In Japanese Patent No. 3871323, in the standby state of the separation feeding mechanism capable of stacking a plurality of sheet materials on the sheet stacking unit, the separation roller in the state of being capable of producing a separating force is at rest in the state where the separation roller is in pressure contact with the feeding roller.

SUMMARY OF THE INVENTION

However, with the device described in Japanese Patent No. 3871323, it is not possible to manually rotate the feeding roller in the standby state of the separation feeding mechanism, and therefore, it is difficult to clean the surface of the feeding roller and the separation roller by using a damp cloth or the like.

Consequently, in view of the above-described problem, an object of one embodiment of the present invention is to provide a printing apparatus in which it is possible to easily clean the surface of a feeding roller and a separation roller by using a damp cloth or the like.

One embodiment of the present invention is a printing apparatus including: a feeding roller that feeds a printing medium; a separation roller capable of selectively taking a state where a separating force that separates a plurality of printing media conveyed by the feeding roller one by one has occurred and a state where the separating force has not occurred at a position at which the separation roller is in pressure contact with the feeding roller; and a control unit configured to perform control to bring about a standby state where transmission of a driving force between a driving source of the feeding roller and the feeding roller is shut off in a state where the separating force has not occurred and the feeding roller and the separation roller abut each other.

Further features of the present invention will become apparent from the following description of exemplary embodiments with reference to the attached drawings.

BRIEF DESCRIPTION OF THE DRAWINGS

FIG. 10A to FIG. 10E are each a cross-sectional diagram explaining an operating state of the driving mechanism in a state P2 in FIG. 4;

DESCRIPTION OF THE EMBODIMENTS

In the following, embodiments of the present disclosure are explained in detail with reference to the attached drawings.

First Embodiment

Figure 1:
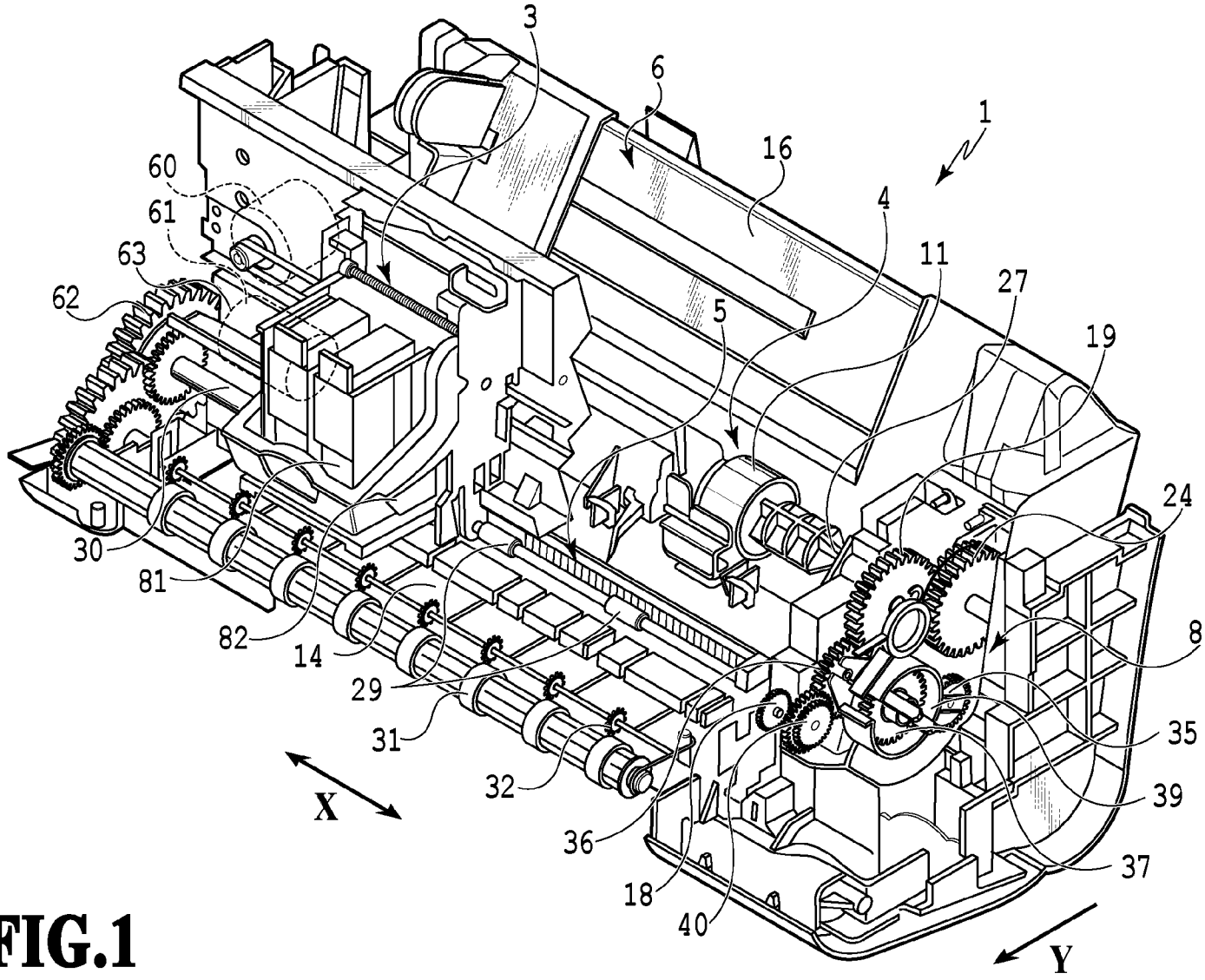
FIG. 1 is a perspective diagram of a printing apparatus of a first embodiment.

As shown in FIG. 1, a printing apparatus 1 has a printing unit 3, a conveyance unit 5, a sheet stacking unit 6, and a feeding unit 4. The printing unit 3 is a member for printing a character, an image and the like on a sheet-shaped printing medium (referred to as sheet material 2, see FIG. 5A to FIG. 5D). The conveyance unit 5 is a member for conveying the sheet material 2 to the printing unit 3. On the sheet stacking unit 6, one or a plurality of the sheet materials 2 is stacked. The feeding unit 4 is a member for feeding the sheet material 2 from the sheet stacking unit 6 to the conveyance unit 5.

The feeding unit 4 includes a feeding roller 11, a separation roller 12 (see FIG. 2, FIG. 5A to FIG. 5D) and the like. The feeding roller 11 is a roller for picking up the sheet material 2 by abutting the uppermost sheet material 2 stacked on the sheet stacking unit 6. The feeding roller 11 rotates by the drive of a conveyance motor 61. The separation roller 12 is a roller for nipping the sheet material 2 together with the feeding roller 11 and separating the sheet material 2 one by one, and is arranged on the downstream side in the conveyance direction from the point at which the feeding roller 11 and the sheet material 2 come into contact with each other for the first time. The separated sheet material 2 is fed to the conveyance unit 5 arranged on the downstream side in the conveyance direction of the separation roller 12.

The printing unit 3 includes a print head 81, a platen 14, a carriage 82 and the like. The print head 81 performs printing for the sheet material 2. In the present embodiment, explanation is given by supposing that the print head 81 is an ink jet print head that performs printing on the sheet material 2 by ejecting ink. The platen 14 supports the backside of the sheet material 2 at the position facing the print head 81. On the carriage 82, the print head 81 is mounted and the carriage 82 moves in a direction (X-direction in FIG. 1) intersecting the conveyance direction of the sheet material 2 by the drive of a carriage motor 60.

The conveyance unit 5 includes a conveyance roller 30, a follower roller 29 and the like. The conveyance roller 30 rotates by the drive of the conveyance motor 61. The follower roller 29 is a follower roller of the conveyance roller 30. The follower roller 29 is biased by the conveyance roller 30 and nips the sheet material 2 together with the conveyance roller 30 and conveys the sheet material 2 to the position facing the print head 81.

A discharge roller 31 rotates by the drive of the conveyance motor 61. A spur 32 is biased by the discharge roller 31 and comes into contact with the printed surface of the sheet material 2 for which printing has been performed by the print head 81 and rotates, and nips the sheet material 2 together with the discharge roller 31, and discharges the sheet material 2 to the outside of the printing apparatus 1.

Next the configuration of a separation feeding mechanism 7 is explained with reference to FIG. 1 to FIG. 3B and FIG. 5A to FIG. 10E.

As shown in FIG. 5A to FIG. 5D, the separation feeding mechanism 7 includes the feeding roller 11, the separation roller 12, a return lever 13, a pre-stage regulation portion 22*a* and the like. By the feeding roller 11 rotating, the sheet material 2 stacked on the sheet stacking unit 6 is sent out. The separation roller 12 is a roller for separating the sheet material 12 one by one by abutting the sheet material 2 sent out by the feeding roller 11. The return lever 13 is a lever for pushing back the sheet material 2 to the sheet material stacking unit 6. The pre-stage regulation portion 22*a* is a member for regulating the number of sheet materials 2 that reach a separation unit.

The feeding roller 11 feeds the uppermost sheet material 2 of a sheet bundle by a frictional force by coming into pressure contact with the sheet bundle biased by a pressure plate 16 and being driven rotationally.

Figure 6:
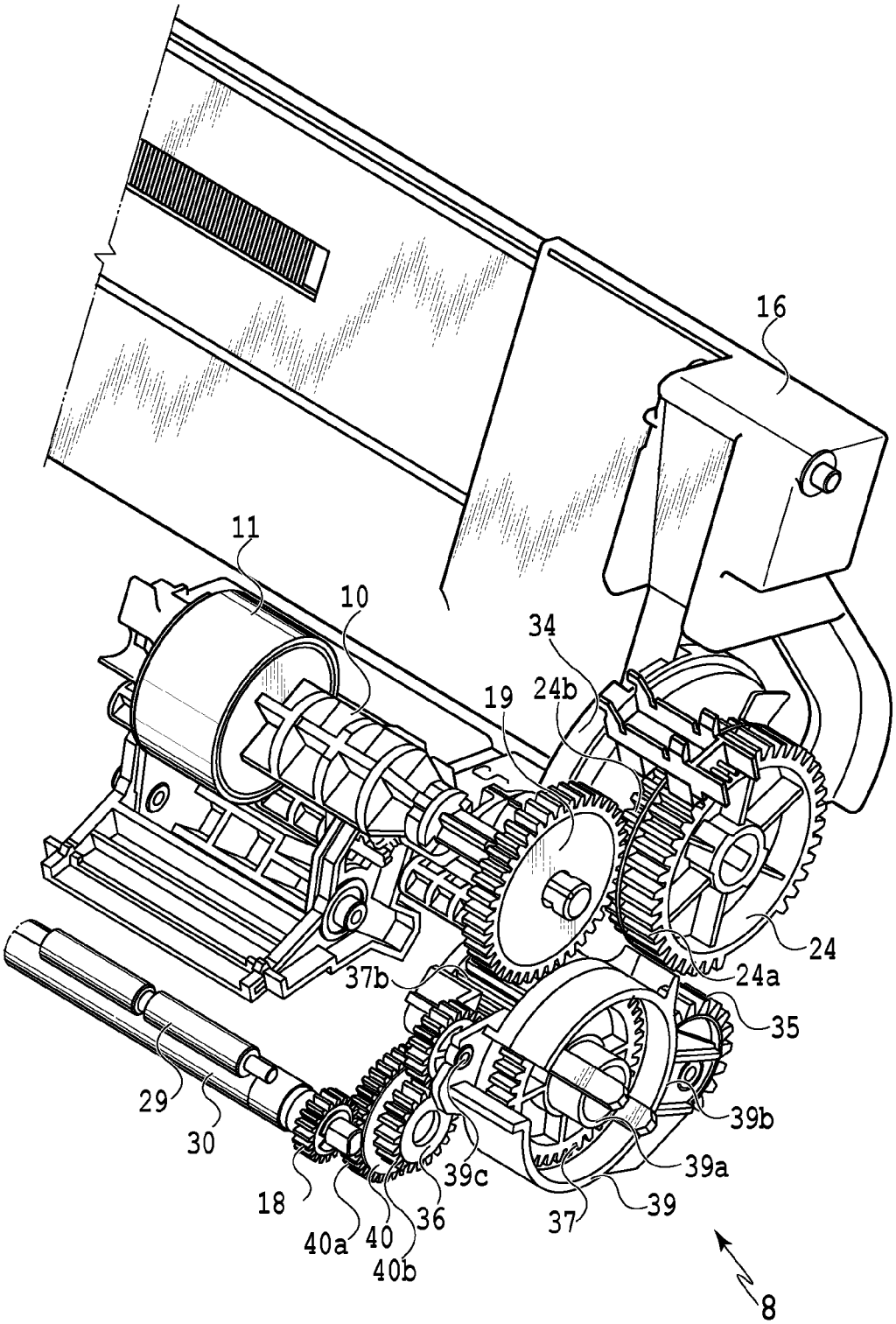
FIG. 6 is a perspective diagram showing a driving mechanism in the printing apparatus of the first embodiment.

A feed axis 10 to which the feeding roller 11 is attached is supported pivotally by a bearing 27 (see FIG. 1) and at one end thereof, a feeding roller gear 19 is provided and a driving force is transmitted from the conveyance motor 61. Further, as shown in FIG. 6, with the feeding roller gear 19, a control gear 24, to be described later, engages. On the same axis as that of the control gear 24, a control cam 34 is provided and the control cam 34 rotates in the same phase as the control gear 24.

Figure 2:
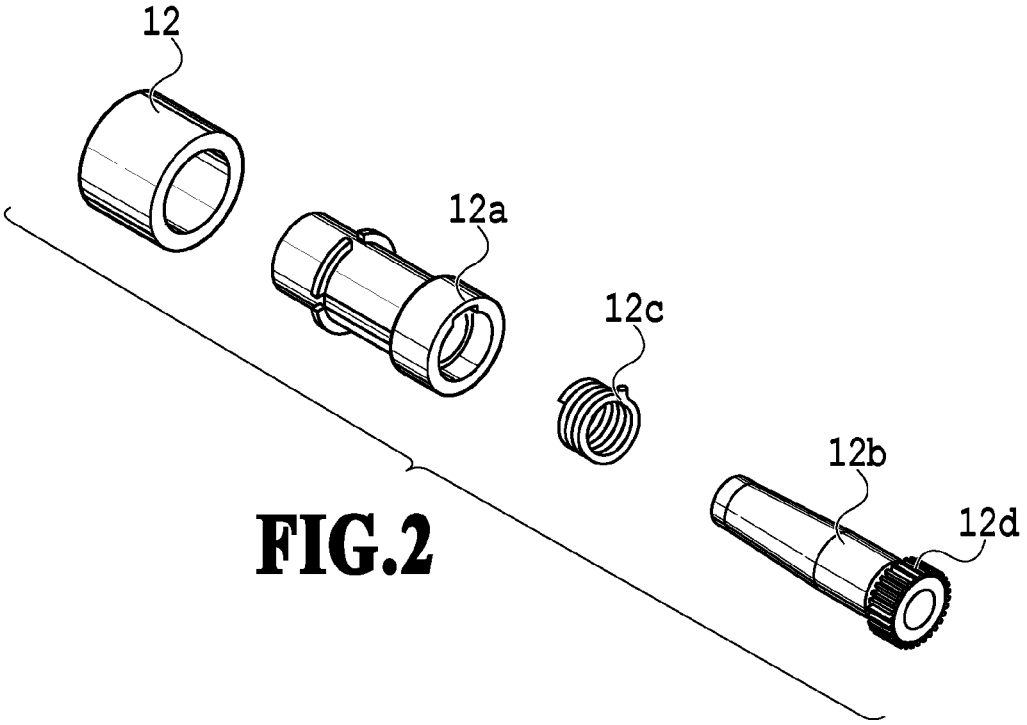
FIG. 2 is an exploded perspective diagram showing a structure of a separation roller in the printing apparatus of the first embodiment.
Figure 3A:
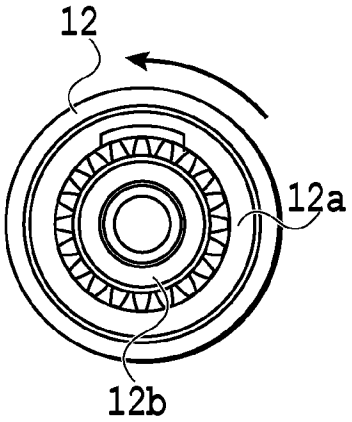
FIG. 3A and FIG. 3B are an elevational diagram and a cross-sectional diagram, respectively, showing the structure of the separation roller in the printing apparatus of the first embodiment.
Figure 3B:
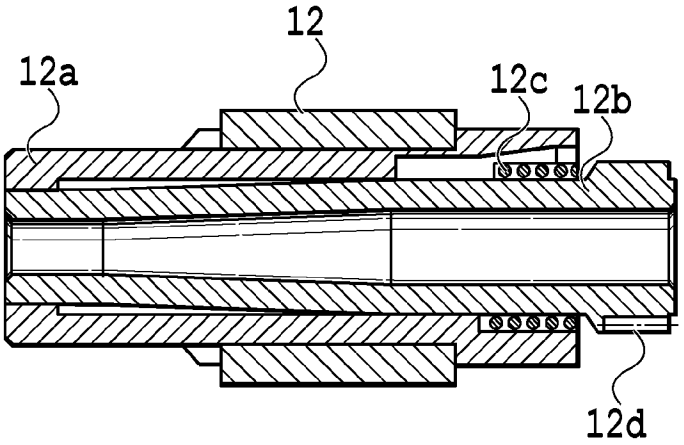

Further, as shown in FIG. 2, the separation roller 12 is attached fixedly to a clutch pipe 12*a* and within the clutch pipe 12*a*, a clutch axis 12*b* is accommodated rotatably. Furthermore, as shown in FIG. 3A and FIG. 3B, the clutch axis 12*b* is wound by a clutch spring 12*c* and one of winding ends of the clutch spring 12*c* is engaged with the clutch pipe 12*a*. The clutch spring 12*c* is formed by a metal coil spring. Further, the clutch axis 12*b* is configured by a mold member and at one end of the clutch axis 12*b*, a gear portion 12*d* is formed integrally.

The separation roller 12 is supported rotatably by a separation roller holder 21 (see FIG. 5A to FIG. 5D), which is a separation unit hold member, via the clutch pipe 12*a* and the clutch axis 12*b*, and pressed against the feeding roller 11 by a separation roller spring 26. To the separation roller holder 21, the separation roller 12 and a lock lever 23 are attached and the separation roller holder 21 is attached to a base 15 so as to pivot with a rotation center 21*a* being taken as a center.

In the configuration described above, in a case where the separation roller 12 and the clutch pipe 12*a* are rotated in a direction of an arrow in FIG. 3A with the clutch axis 12*b* being fixed, the clutch spring 12*c* wound around the clutch axis 12*b* is unwound from the clutch axis 12*b*. The configuration is designed so that in a case where the separation roller 12 and the clutch pipe 12*a* rotate a predetermined angle, a predetermined torque is maintained by the clutch axis 12*b* and the clutch spring 12*c* sliding relatively. Further, in the present embodiment, by fixing the clutch axis 12*b* and cancelling the fixation thereof, it is made possible to control on and off of a torque limiter. Furthermore, as a state switching unit for switching between a state where a separating force of the separation roller 12 has occurred and a released state where the separating force of the separation roller 12 has not occurred, a release cam 28 and the lock lever 23 are comprised.

As shown in FIG. 5A to FIG. 5D, the release cam 28 has a pre-stage regulation holder operation portion 28*a*, a separation roller holder operation portion 28*b*, and a lock lever operation portion 28*c* and at each operation portion, the pre-stage regulation holder 22, the separation roller holder 21, and the lock lever 23 are pivoted. Further, the release cam 28 has a control cam operation portion 28*d* and by the pivot of the control cam 34, the release cam 28 pivots in accordance with the cam surface, to be described later, of the control cam 34 (see FIG. 9B, FIG. 10B).

Figure 5A:
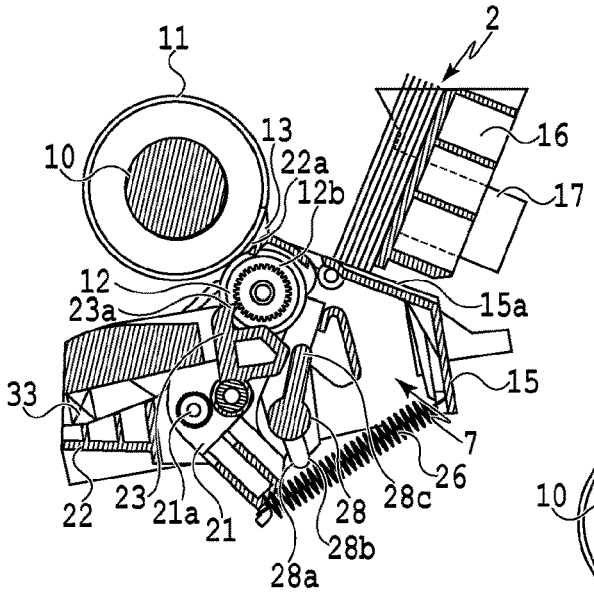
FIG. 5A to FIG. 5D are each a diagram explaining the operation of the feeding unit in the printing apparatus of the first embodiment.

According to the separation feeding mechanism 7 thus configured, as shown in FIG. 5A, in a case where the sheet material 2 has not entered between the feeding roller 11 and the separation roller 12, the separation roller 12 rotates in a following manner accompanying the rotation of the feeding roller 11.

Figure 5B:
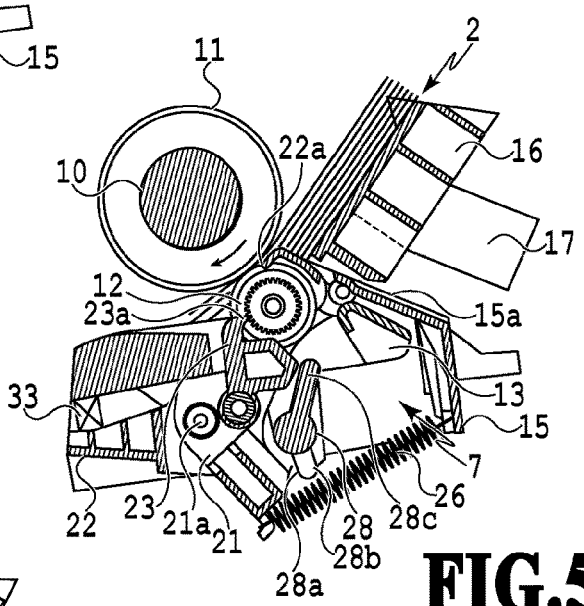

As shown in FIG. 5B, in a case where the one sheet material 2 has entered between the feeding roller 11 and the separation roller 12, the frictional force between the feeding roller 11 and the sheet material 2 is greater than the frictional force between the separation roller 12 that follows with a predetermined torque and the sheet material 2. Because of this, the sheet material 2 is conveyed while the separation roller 12 is following.

Figure 5C:
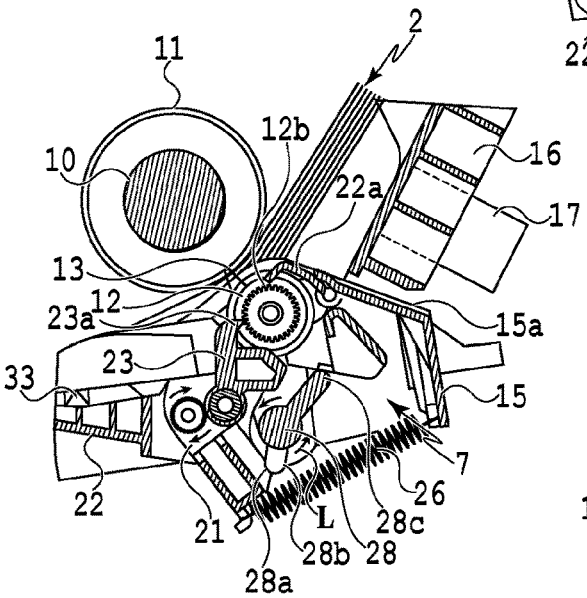
Figure 5D:
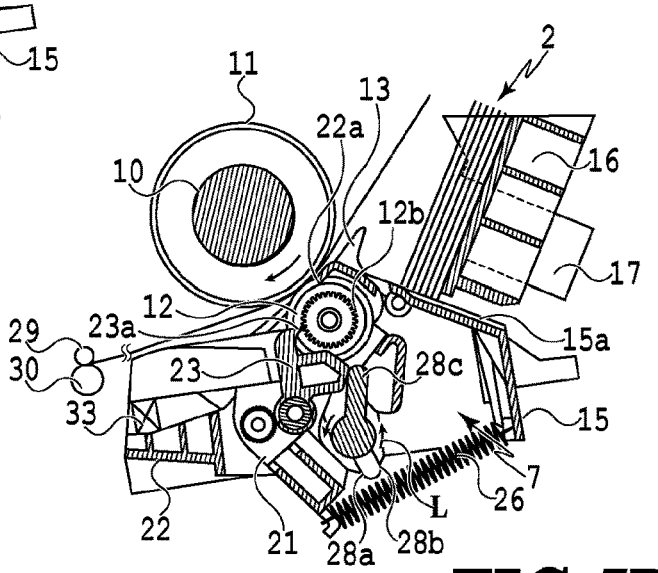

However, in a case where the two sheet materials 2 have entered between the feeding roller 11 and the separation roller 12, the frictional force between the feeding roller 11 and the sheet material 2 adjacent to the side of the feeding roller 11 becomes greater than the frictional force between the sheet materials 2. Further, the frictional force between the sheet material 2 adjacent to the side of the torque limiter and the separation roller 12 becomes greater than the frictional force between the sheet materials 2, and therefore, a slide occurs between the sheet materials 2. As a result of that, as shown in FIG. 5C and FIG. 5D, only the sheet material 2 located on the side of the feeding roller 11 is conveyed and the sheet material 2 located on the side of the separation roller 12 stops at the position accompanying the stop of the rotation of the separation roller 12 and is not conveyed.

Because of this, the separation feeding mechanism 7 is provided with the return lever 13 for preventing overlap feeding of the sheet material 2, in addition to the separation roller 12. That is, in a case where the two sheet materials 2, more or less, have entered the inside of a nip portion of the feeding roller 11 and the separation roller 12, it is possible to separate the sheet materials 2 by the separation roller 12.

However, there is a possibility that a problem occurs in a case where the three or more sheet materials 2 have entered or in a case where the two sheet materials 2 have entered and after only the sheet material 2 on the side of the feeding roller 11 is conveyed, an attempt is made to feed the next sheet material 2 successively with the sheet material 2 being left in the vicinity of the nip portion. Specifically, in these cases, there is a possibility that a plurality of the sheet materials 2 is fed at the same time, that is, so-called overlap feeding occurs. In order to prevent this overlap feeding, the return lever 13 is provided.

In the printing apparatus 1 in the present embodiment, at the time of setting of the sheet material 2 or at the time of print standby, by causing the return lever 13 to enter the inside of the conveyance path of the sheet material 2, the front end of the sheet material 2 is prevented from entering deeply into the conveyance path unexpectedly. The return lever 13 is configured so as to retract from the conveyance path of the sheet material 2 by being released and pivoted after the start of the feeding operation, and therefore, the return lever 13 does not impede the onward movement of the sheet material 2 during feeding of the sheet material 2.

In a case where the separating operation is completed, the return lever 13 moves to the returning operation to push back the sheet material 2 at the next and subsequent positions located within the nip portion. Then, after the returning operation is completed, the return lever 13 is pivoted up to a position at which the return lever 13 temporarily retracts from the conveyance path of the sheet material 2. The return lever 13 is configured so as to return again to the position of a first standby state of the feeding unit 4 in a case where it is checked that the rear end of the fed sheet material 2 is discharged from the printing apparatus 1 after that. Details of the first standby state of the feeding unit 4 will be described later (see FIG. 9A to FIG. 9D).

As shown in FIG. 5B, the pre-stage regulation portion 22*a* is a member for forming a gap between the pre-stage regulation unit 22*a* and the feeding roller 11 on the upstream side of the separation unit and regulating the sheet materials 2 that enter the inside of the separation unit to a few. The pre-stage regulation portion 22*a* is provided in the pre-stage regulation holder 22. The pre-stage regulation holder 22 is attached to the base 15 so as to be capable of pivoting with the same rotation center 21*a* as that of the separation roller holder 21 being taken as a center. The pre-stage regulation holder 22 is biased by a pre-stage regulation holder spring 33 and positioned by part thereof being abutted to the base 15.

Figure 7:
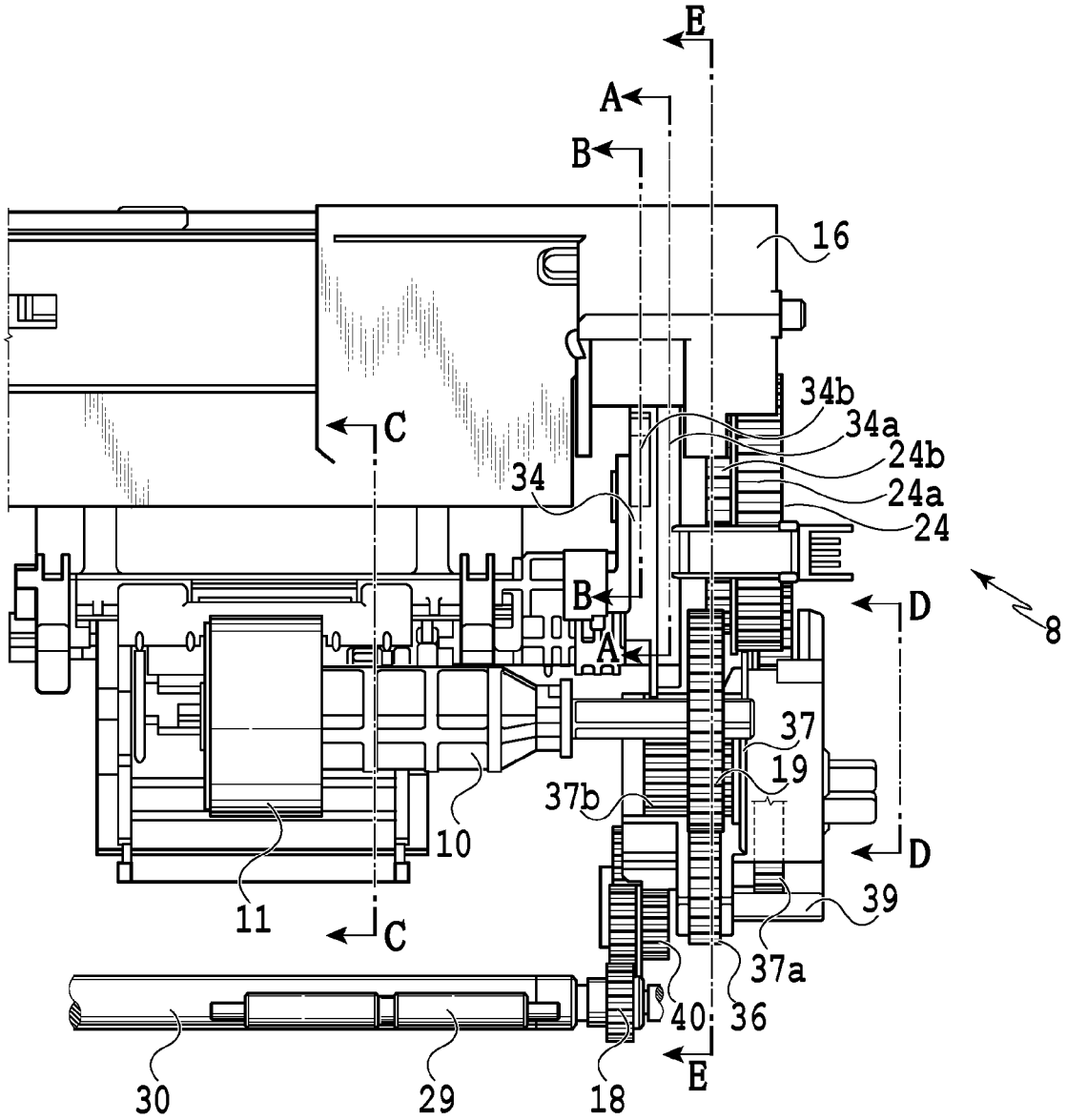
FIG. 7 is a plan diagram showing the driving mechanism in the printing apparatus of the first embodiment.

The state change of the feeding unit 4 configured as described above is explained with reference to FIG. 9A to FIG. 9D and FIG. 10A to FIG. 10E. Each of FIG. 9A to FIG. 9D and FIG. 10A to FIG. 10E shows a cross-sectional diagram of each part in FIG. 7 and FIG. 9A and FIG. 10A show an A-A cross section, FIG. 9B and FIG. 10B show a B-B cross section, FIG. 9C and FIG. 10C show a C-C cross section, FIG. 9D, FIG. 10D-1, and FIG. 10D-2 show a D-D cross section, and FIG. 10E shows an E-E cross section, respectively, Further, FIG. 9A to FIG. 9D and FIG. 10A to FIG. 10E correspond to the state P1 and the state P2, respectively, in FIG. 4 in accordance with the rotation angle of the control cam 34.

Figure 4:
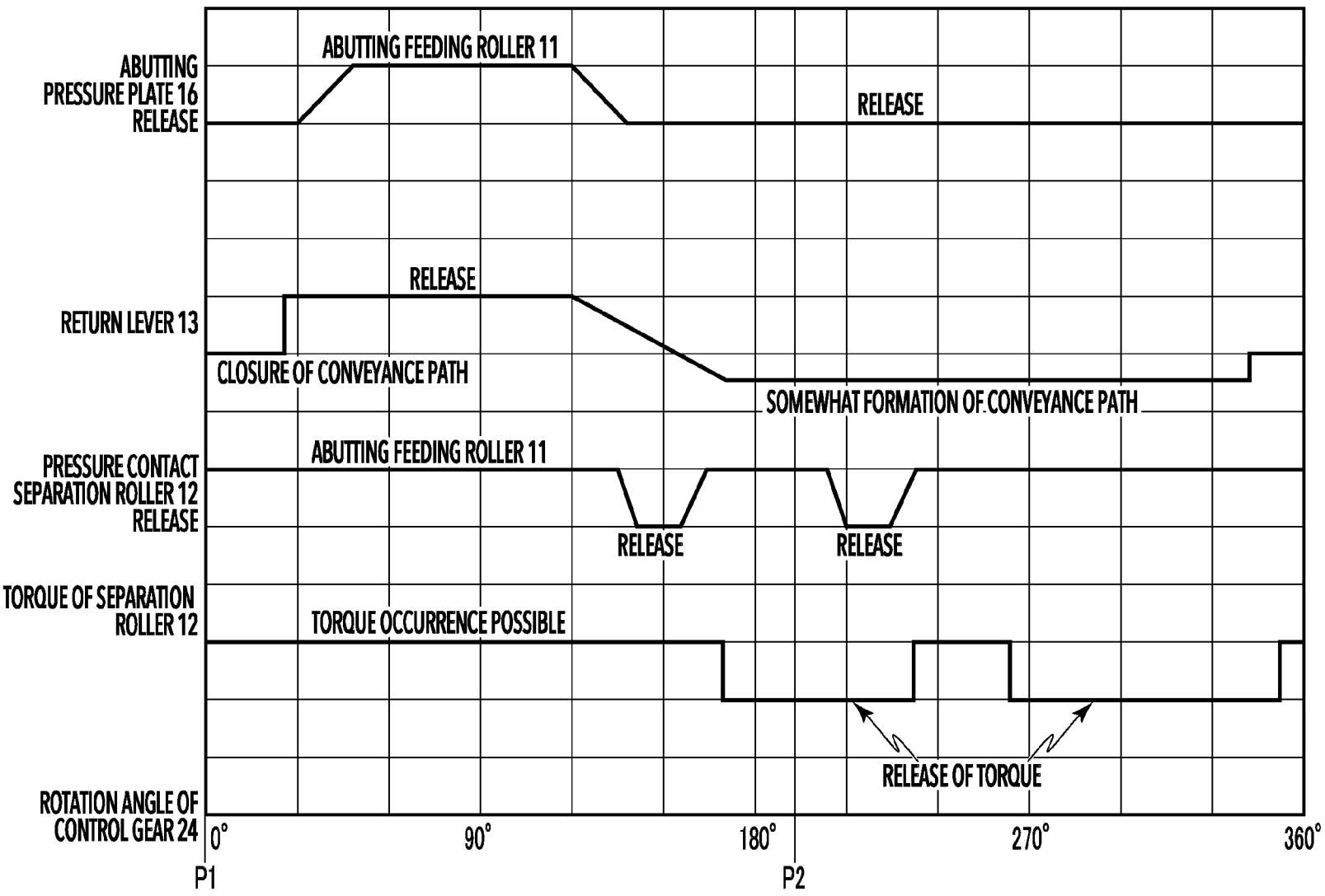
FIG. 4 is a timing chart explaining an operation of a feeding unit in the printing apparatus of the first embodiment.

FIG. 9A to FIG. 9D show the first standby state of the feeding unit 4, which corresponds to the state P1 in FIG. 4.

Figure 9A:
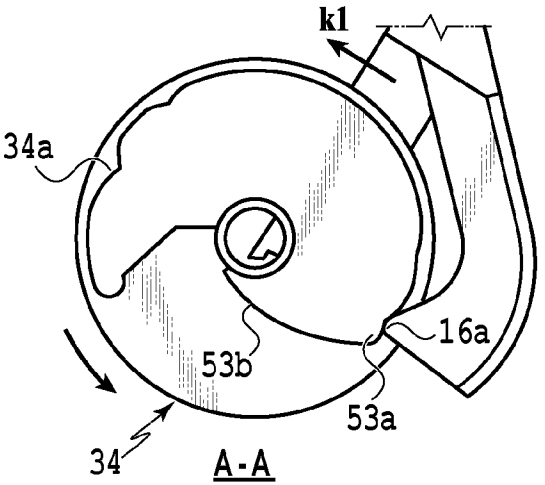
FIG. 9A to FIG. 9D are each a cross-sectional diagram explaining the operating state of the driving mechanism in a state P1 in FIG. 4.

As shown in FIG. 9A, a first cam surface 34*a* of the control cam 34 is provided with a first concave portion 53*a* and in the first standby state, a pressure plate boss 16*a* is engaged with the first concave portion 53*a*. That is, the pressure plate 16 is held in the first standby state by the first cam surface 34*a* of the control cam 34 and at the same time, by an elastic force of a pressure plate spring 17, the pressure plate 16 is biased to the side of the control cam 34. Because of this, by the pressure plate boss 16*a* engaged with the first concave portion 53*a* of the control cam 34, a holding force works and the rotation of the control cam 34 is constrained.

Figure 9B:
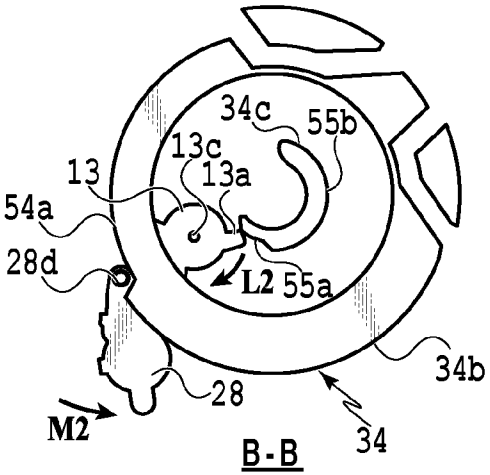
Figure 9C:
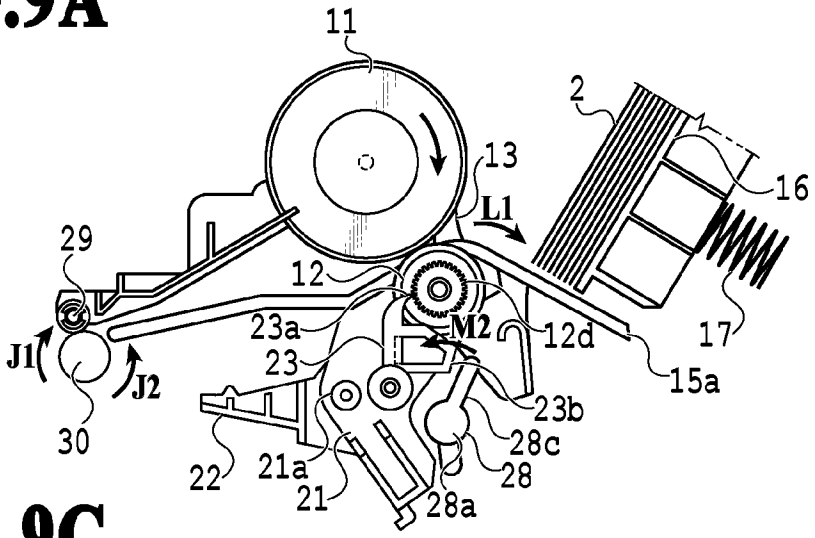

FIG. 9B shows a second cam surface 34*b* and a third cam surface 34*c* of the control cam 34. As shown in FIG. 9B, the control cam operation portion 28*d* of the release cam 28 is engaged with one end of a control cam surface 54*a* included in the second cam surface 34*b* of the control cam 34. Further, a protruding portion 13*a* of the return lever 13 is engaged with a control cam surface 55*a* included in the third cam surface 34*c*.

FIG. 9C shows the state of the separation feeding mechanism 7 at the time of the state P1. As shown in FIG. 9C, the pressure plate 16 is held at the position separate from the feeding roller 11 whose cross-sectional shape is formed into a circle and between the feeding roller 11 and the pressure plate 16, a space large enough to stack a plurality of the sheet materials 2 is secured. Further, the return lever 13 has entered the conveyance path of the sheet material 2 and prevents the front end of the sheet material 2 stacked on the pressure plate 16 from falling on the side of the separation roller 12.

Figure 9D:
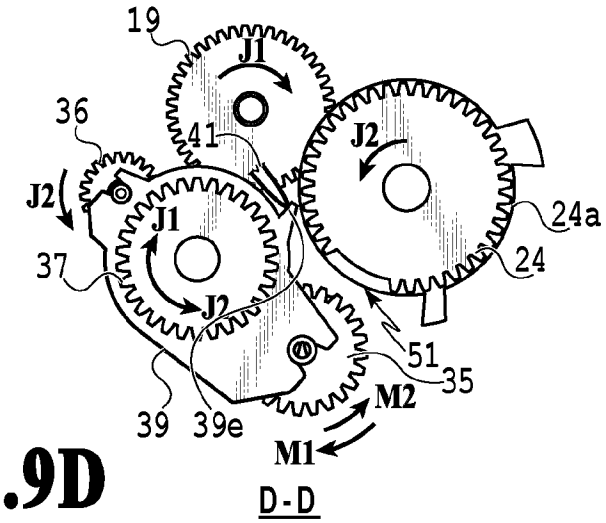

Further, as shown in FIG. 9D, a first gear portion 24*a* of the control gear 24 is provided with a first toothless section 51 and at rest in the state of being separate from the control gear 24 at the position at which the first toothless section 51 faces a forward rotation planetary gear 35 in the first standby state. A reverse rotation planetary gear 36 is also at rest in the state of being separate from the feeding roller gear 19. At this time, a protruding portion 39*e* of a pendulum 39 abuts a stopper 41, and therefore, even in a case where a sun gear 37 rotates in a direction of an arrow J2 in FIG. 9D, the pendulum 39 does not rotate in a direction of an arrow M2 in FIG. 9D. Consequently, in the first standby state, the drive connection from the conveyance motor 61 is in the state of being cut off from the control gear 24.

At this time, the pre-stage regulation holder operation portion 28*a* of the release cam 28 is located at the position separate from the separation roller holder 21, and therefore, the separation roller 12 is in the state of being in pressure contact with the feeding roller 11. Further, a protruding portion 23*a* of the lock lever 23 is engaged with the gear portion 12*d* at the end portion of the clutch axis 12*b*, and therefore, the state is such that a torque of the separation roller 12 may occur. Furthermore, the sheet material 2 stacked on the sheet stacking unit 6 enters the state where the front end is supported by a sheet material front end reference portion 15*a* and the backside is supported by the pressure plate 16.

Further, the separation feeding mechanism 7 changes the state as shown in FIG. 4 by rotating the feeding roller 11 from the first standby state using the drive of a driving mechanism 8, to be described later, and returns to the first standby state again.

FIG. 10A to FIG. 10E each show the state of the feeding unit 4 corresponding to the state P2 in FIG. 4.

As shown in FIG. 10A, the first cam surface 34*a* of the control cam 34 is provided with a second concave portion 53*f* and the pressure plate boss 16*a* is engaged with the second concave portion 53*f* That is, in a case where the pressure plate 16 stops in the state P2 shown in FIG. 4, the pressure plate 16 is held in the state in FIG. 10A by the first cam surface 34*a* of the control cam 34. Further, at the same time, the pressure plate 16 is biased toward the side of the control cam 34 by the elastic force of the pressure plate spring 17. Because of this, the holding force works by the pressure plate boss 16*a* engaged with the second concave portion 53*f* of the control cam 34, and therefore, the rotation of the control cam 34 is constrained.

FIG. 10B shows the second cam surface 34*b* and the third cam surface 34*c* of the control cam 34. As shown in FIG. 10B, the control cam operation portion 28*d* of the release cam 28 is engaged with a control cam surface 54*b* whose diameter is larger than that of the control cam surface 54*a* included in the second cam surface 34*b* of the control cam 34. Because of this, the release cam 28 pivots in the direction of the arrow M2 in FIG. 9B from the state in FIG. 9B and the lock lever operation portion 28*c* of the release cam 28 pushes up a cam surface 23*b* of the lock lever 23 in the direction of the arrow M2 in FIG. 9C and the state shown in FIG. 10C is brought about.

Further, the protruding portion 13*a* of the return lever 13 is engaged with a control cam surface 55*b* whose diameter is larger than that of the control cam surface 55*a* included in the third cam surface 34*c*. Because of this, the return lever 13 pivots in a direction of an arrow L1 in FIG. 9C from the state in FIG. 9C and the state in FIG. 10C is brought about.

FIG. 10C shows the state of the separation feeding mechanism 7 at the time of the state P2. As shown in FIG. 10C, the pressure plate 16 is held at the position separate from the feeding roller 11 whose cross-sectional shape is formed into a circle and between the feeding roller 11 and the pressure plate 16, a space large enough to stack a plurality of the sheet materials 2 is secured. However, different from FIG. 9C, the return lever 13 is pivoted and on the surface side of the feeding roller 11 of the return lever 13, the conveyance path of the sheet material 2 is formed in a somewhat amount.

FIG. 10E shows the state of the feeding roller gear 19 and the control gear 24. As shown in FIG. 10E, the state is such that a third toothless section 52*b* of the control gear 24 is located at the portion facing the feeding roller gear 19, and therefore, the feeding roller gear 19 does not engage with the control gear 24 and the control gear 24 is the state of not being rotated.

In this state also, the pre-stage regulation holder operation portion 28*a* of the release cam 28 is located at the position separate from the separation roller holder 21, and therefore, the separation roller 12 is in the state of being in pressure contact with the feeding roller 11. Further, the protruding portion 23*a* of the lock lever 23 disengages from the gear portion 12*d* of the clutch axis 12 and the clutch axis 12*b* is set free, and therefore, the state is such that the torque of the separation roller 12 does not occur. That is, the separation roller 12 is a so-called follower roller of the feeding roller 11. Further, the transmission of the driving force by the feeding roller gear 19 to the control gear 24 is shut off by the third toothless section 52*b*, and therefore, even in a case where the feeding roller gear 19 rotates, the control gear 24 and the control cam 34 are held in this state. Then, the sheet material 2 stacked on the sheet material stacking unit 6 enters the state where the front end is supported by the sheet material front end reference portion 15*a* and the backside is supported by the pressure plate 16.

At this time, in a case where the drive of the feeding roller 11 is stopped as a second standby state, from the state shown in FIG. 10D-1, by driving the conveyance motor 61, the sun gear 37 is rotated in the direction of the arrow J2 in FIG. 10D-1 and the pendulum 39 is pivoted in the direction of the arrow M2 in FIG. 10D-1. Then, in the state where the protruding portion 39*e* of the pendulum 39 abuts the stopper 41, the drive of the conveyance motor 61 is stopped. Due to this, the state where the forward rotation planetary gear 35 is separate from the control gear 24 and the reverse rotation planetary gear 36 is separate from the feeding roller gear 19, that is, the state where the drive connection from the conveyance motor 61 is cut off between the control gear 24 and the feeding roller gear 19 is brought about.

Figure 8:
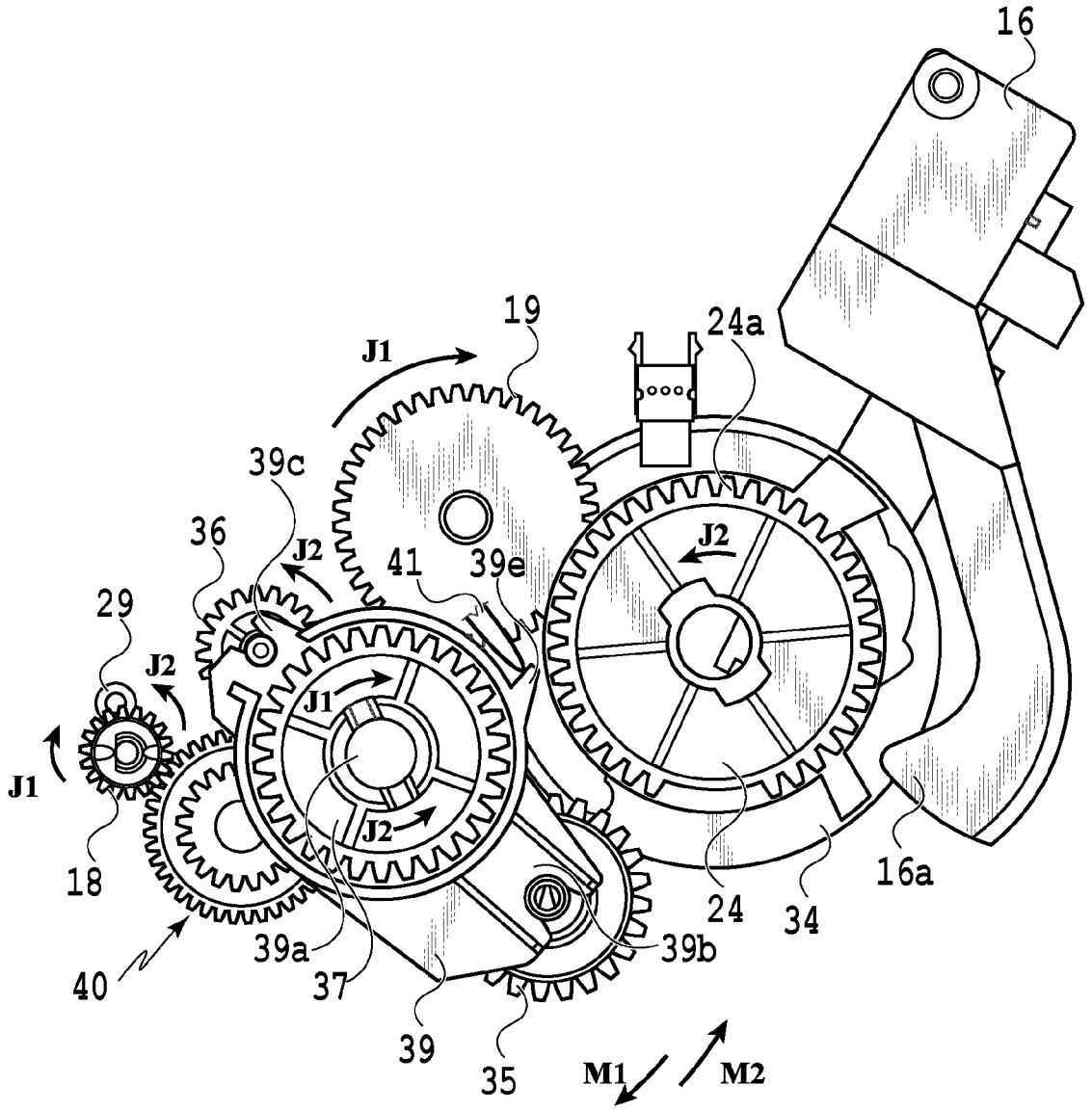
FIG. 8 is a side diagram showing the driving mechanism in the printing apparatus of the first embodiment.

Next, the driving mechanism 8 for driving the feeding unit 4 is explained by using FIG. 6 to FIG. 8. FIG. 6 is a perspective diagram of the driving mechanism 8, FIG. 7 is a plan diagram of the driving mechanism 8, and FIG. 8 is a side diagram of the driving mechanism 8.

The driving mechanism 8 of the feeding unit 4 is configured by each part being attached to a support base and as shown in FIG. 6 to FIG. 8, the driving mechanism 8 has the feeding roller gear 19 for rotationally driving the feeding roller 11 and the control gear 24 and the control cam 34 that rotationally drive in an integrated manner. Further, the driving mechanism 8 has the sun gear 37 for allocating the driving force to the forward rotation planetary gear 35 and the reverse rotation planetary gear 36, and the feeding roller gear 19 and the control gear 24, and the pendulum 39 that swings the forward rotation planetary gear 35 and the reverse rotation planetary gear 36. Further, the driving mechanism 8 has an idler gear 40 for transmitting the driving force to the conveyance unit 5 and the stopper 41 for regulating the swing of the pendulum 39.

As described previously, the feeding roller gear 19 is provided at one end of the feed axis 10 and by the feeding roller gear 19 rotating, the feed axis 10 and the feeding roller 11 are rotated.

The control gear 24 has the first gear portion 24*a* engaged with the forward rotation planetary gear 35 and a second gear portion 24*b* engaged with the feeding roller gear 19.

The control cam 34 is provided on the same axis as that of the control gear 24 and rotates in the same phase as the control gear 24. As described previously, the control cam 34 has the first cam surface 34*a* engaged with the pressure plate boss 16*a* of the pressure plate 16, the second cam surface 34*b* engaged with the control cam operation portion 28*d* of the release cam 28, and the third cam surface 34*c* engaged with the protruding portion 13*a* of the return lever 13.

The sun gear 37 has a first gear portion 37*a* engaged with the forward rotation planetary gear 35 and a second gear portion 37*b* engaged with the reverse rotation planetary gear 36.

In the pendulum 39, each of a bearing portion 39*a* that supports the sun gear 37 via the rotation axis, a bearing portion 39*b* that supports the sun gear 37 via the rotation axis of the forward rotation planetary gear 35, and a bearing portion 39*c* that supports the sun gear 37 via the rotation axis of the reverse rotation planetary gear 36 is formed integrally.

Between the sun gear 37 and the pendulum 39, a friction spring (not shown schematically) is provided and by the friction of this friction spring, the pendulum 39 is also swung in the same direction together with the rotation of the sun gear 37. That is, in a case where the sun gear 37 rotates in a direction of an arrow J1 in FIG. 8, the pendulum 39 is also swung in an M1 direction and the reverse rotation planetary gear 36 is engaged with the feeding roller gear 19. On the contrary, in a case where the sun gear 37 rotates in the direction of the arrow J2 in FIG. 8, the pendulum 39 is also swung in the M2 direction and the forward rotation planetary gear 35 is engaged with the first gear portion 24*a* of the control gear 24.

The idler gear 40 has a first gear portion 40*a* engaged with an output gear 18 and a second gear portion 40*b* engaged with the second gear portion 37*b* of the sun gear 37 and transmits the driving force of the output gear 18 to the sun gear 37. The stopper 41 is provided pivotally at the position adjacent to the pendulum 39.

Figure 11:
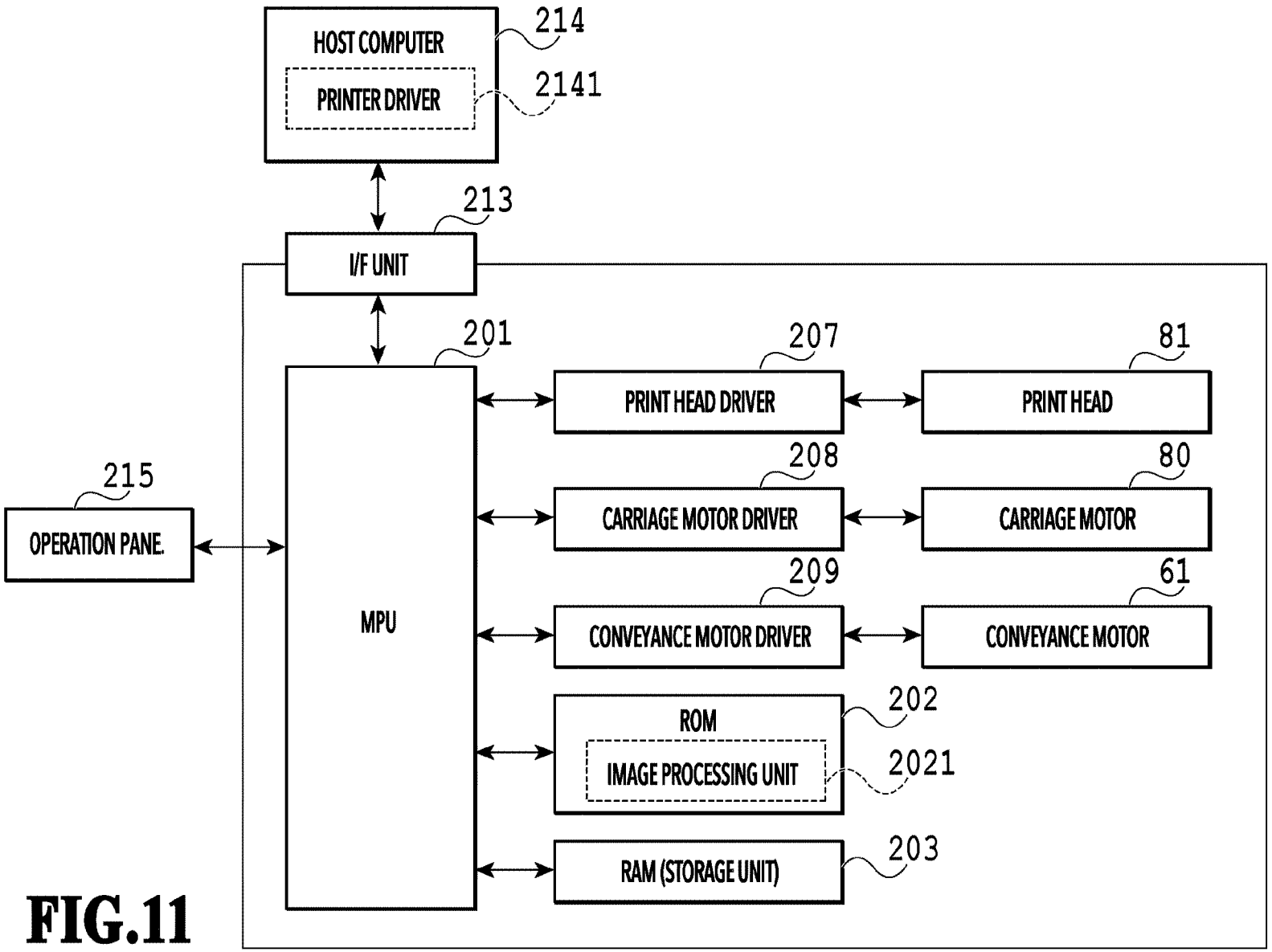
FIG. 11 is a block diagram showing a hardware configuration of the printing apparatus of the first embodiment.

FIG. 11 is a block diagram showing the hardware configuration of the printing apparatus in the present embodiment. An MPU 201 controls the operation of each unit, processing of data and the like. As will be described later, the MPU 201 also functions as a switch control unit configured to switch the standby states of the separation feeding mechanism 7. In a ROM 202, programs executed by the MPU 201, data, and the like are stored. In a RAM 203, data for processing performed by the MPU 201, data received from a host computer 214, and the like are stored temporarily. An operation unit 215 is a unit via which a user specifies operation contents to the printing apparatus, or via which for displaying and presenting information on the situation of the printing apparatus and the like.

Figure 12:
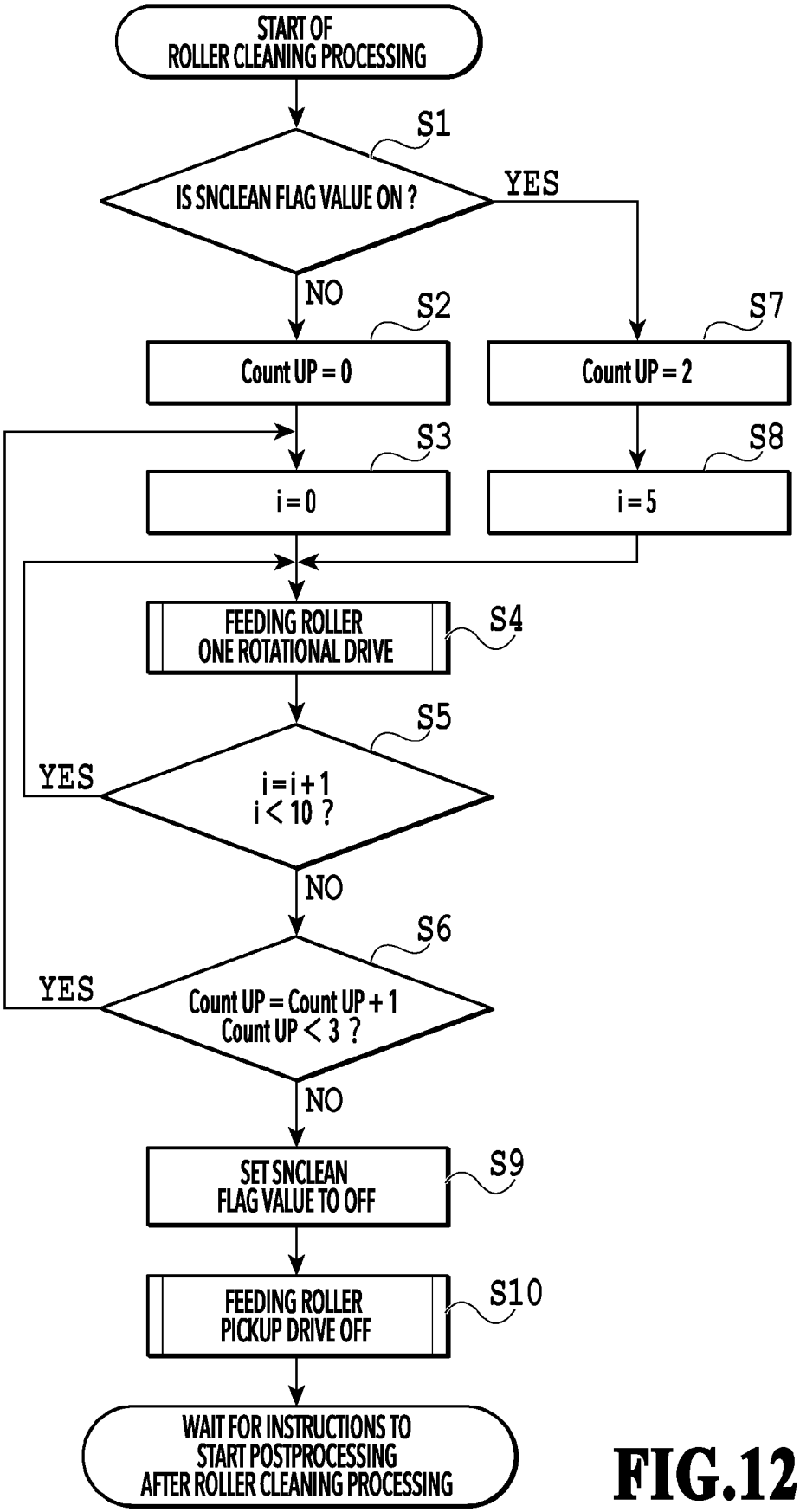
FIG. 12 is a flowchart of roller cleaning processing in the first embodiment.
Figure 13:
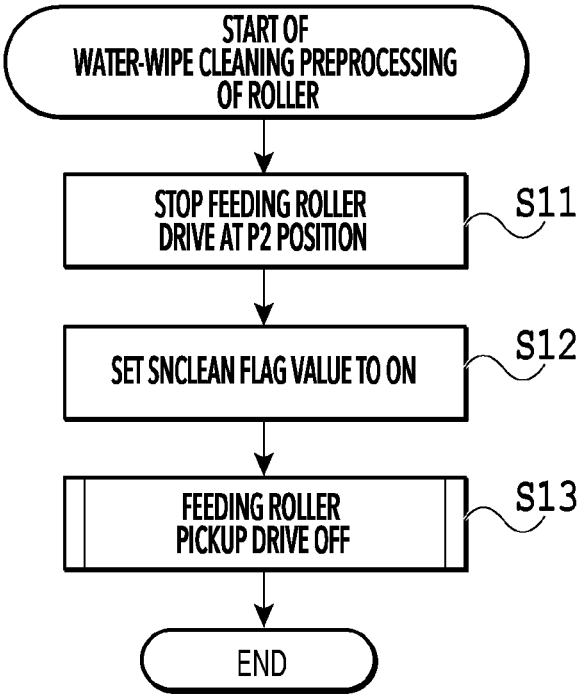
FIG. 13 is a flowchart of processing (preprocessing) for bringing about a second standby state in the first embodiment.
Figure 14:
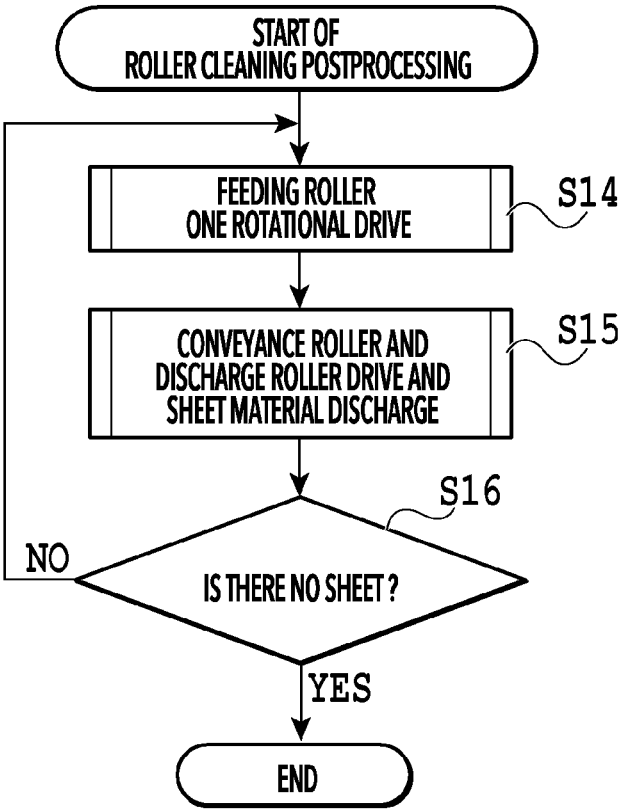
FIG. 14 is a flowchart of processing (postprocessing) that is performed after roller cleaning in the first embodiment.
Figure 15:
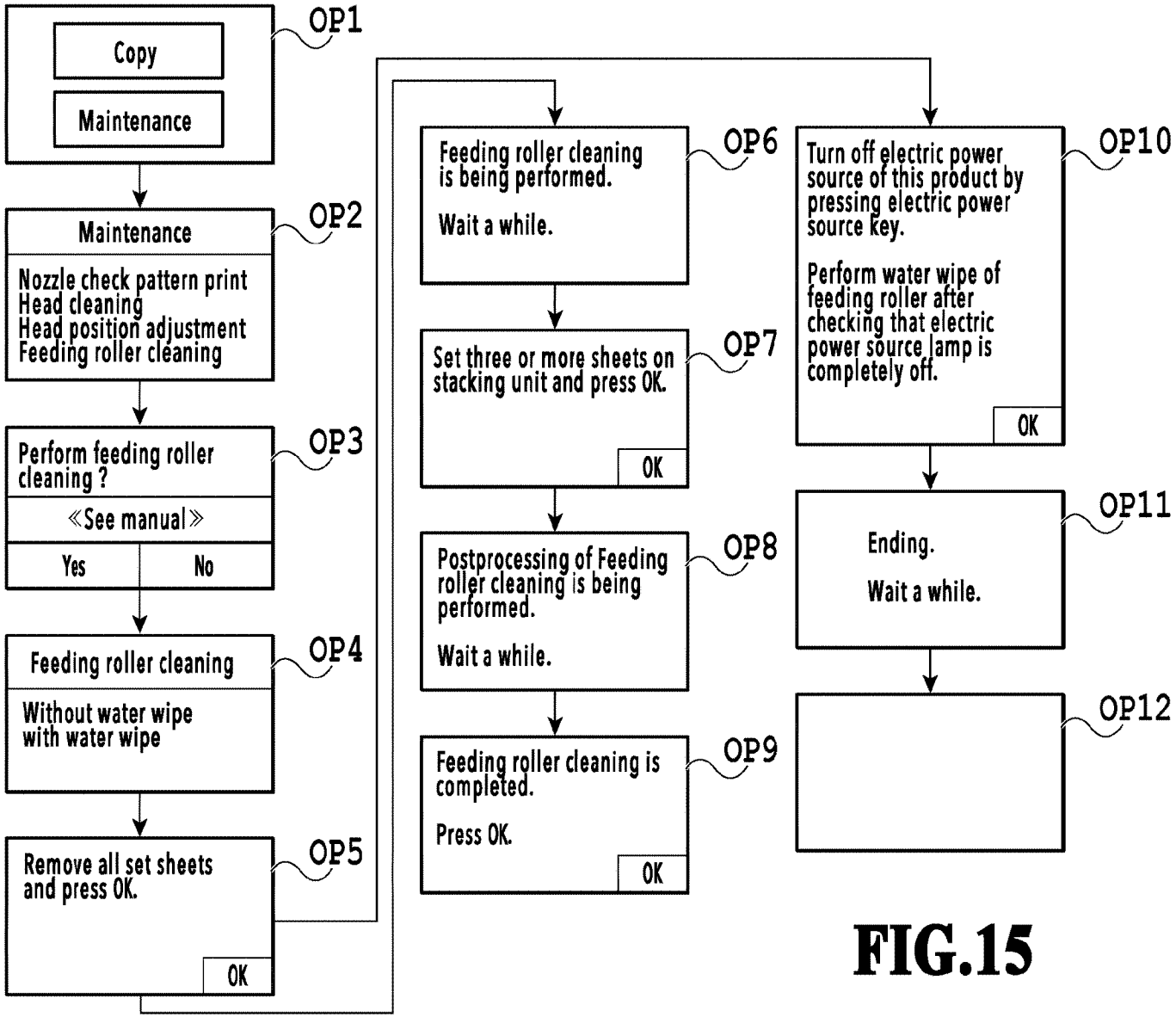
FIG. 15 is a diagram showing a change in a GUI in the first embodiment.

FIG. 12 is a flowchart of cleaning processing of the feeding roller 11 in the present embodiment, specifically, cleaning processing, not a wipe with a damp cloth (hereinafter, called "water wipe"). FIG. 13 is a flowchart of processing (called preprocessing of water-wipe cleaning, preprocessing, and the like) that is performed before water-wipe cleaning processing of the feeding roller 11 in the present embodiment. FIG. 14 is a flowchart of processing (in the present specification, simply called postprocessing) that is performed after the cleaning processing of the feeding roller 11 including the water-wipe cleaning. FIG. 15 is a diagram showing a change in a GUI screen that is displayed on the operation panel 215 at the time of a user giving instructions to perform the water-wipe cleaning processing or the like via the operation panel 215. Based on the contents selectively specified via the operation panel 215, the MPU 201 performs driving processing of the separation feeding mechanism 7.

In a case where the feeding unit 4 is in the first standby state of the separation feeding mechanism 7 shown in FIG. 4 and FIG. 9A to FIG. 9D, by pressing down a "Maintenance" button on a GUI screen OP1 that is displayed on the operation panel 215, a GUI screen OP2 is displayed in place of the GUI screen OP1. The GUI screen OP2 is a screen for selecting various maintenance items. In the following, a case is explained where a button is adopted as an instruction item, but it may also be possible to adopt an arbitrary instruction item other than a button.

In a case where a user selects "Feeding roller cleaning" on the GUI screen OP2, a GUI screen OP3 is displayed in place of the GUI screen OP2. The GUI screen OP3 is a screen for causing a user to check whether or not to perform feeding roller cleaning and leading the user to see the manual. In a case where a user selects "Yes" on the GUI screen OP3, a GUI screen OP4 is displayed in place of the GUI screen OP3. On the other hand, in a case where a user selects "No" on the GUI screen OP3, the GUI screen OP1 is displayed again in place of the GUI screen OP3 and the initial state returns.

The GUI screen OP4 is a screen for causing a user to select to perform cleaning of the feeding roller 11 without a water wipe or with a water wipe. In a case of desiring to perform automatic cleaning without a water wipe, a user selects a "Without water wipe" instruction item on the GUI screen OP4 and on the other hand, in a case of desiring to perform manual cleaning with a water wipe, the user selects a "With water wipe" instruction item on the GUI screen OP4.

First, a case where the "Without water wipe" instruction item is selected on the GUI screen OP4 is explained by using FIG. 12, FIG. 14, and FIG. 15.

In a case where the "Without water wipe" instruction item on the GUI screen OP4 is selected by a user, a GUI screen OP5 is displayed in place of the GUI screen OP4. The GUI screen OP5 has a message that leads a user to remove all the sheet materials 2 stacked on the sheet stacking unit 6 and press down an OK button, and the OK button. In a case where the OK button on the GUI screen OP5 is pressed down by a user, a GUI screen OP6 is displayed in place of the GUI screen OP5 and cleaning processing without a water wipe of the feeding roller 11 (called without-water-wipe roller cleaning processing and the like) shown in FIG. 12 is started.

The GUI screen OP6 has a message indicating that the feeding roller 11 is being cleaned and the display of the GUI screen OP6 continues until the series of processing shown in FIG. 12 is completed. At step S1 in FIG. 12, the MPU 201 determines whether or not the processing shown in FIG. 13 for performing the water-wipe cleaning for the feeding roller 11 has been performed in advance. Specifically, the MPU 201 determines whether the value of an SNCLEAN flag indicating whether or not the processing shown in FIG. 13 has been performed is ON (indicating that the processing has been performed). In a case where the determination results at this step are affirmative (that is, the SNCLEAN flag value is ON), the processing advances to S7. On the other hand, in a case where the determination results at this step are negative (that is, the SNCLEAN flag value is OFF), the processing advances to S2. Hereinafter, "step S-" is abbreviated to "S-".

At S2, the MPU 201 sets the value of a CountUP counter that stores the number of times 10 rotational drives is performed for the feeding roller 11 to 0. Further, next at S3, the MPU 201 also sets the value of an i counter that stores the number of times one rotational drive is performed for the feeding roller 11 to 0.

At S4, MPU 201 performs the one rotational drive of the feeding roller 11. Specifically, the MPU 201 first drives the conveyance motor 61. The driving force of the conveyance motor 61 is transmitted from a conveyance motor gear 63 fixed to the conveyance motor 61 to a conveyance roller gear 62 fixed to one end of the conveyance roller 30, and rotates the output gear 18 fixed to the other end of the conveyance roller 30 in the direction of the arrow J1 in FIG. 9C. Due to this, the driving force is transmitted from the output gear 18 to the idler gear 40 and the sun gear 37 and the sun gear 37 rotates in the direction of the arrow J1 in FIG. 9D, and therefore, the pendulum 39 rotates in the direction of the arrow M1. Then, the reverse rotation planetary gear 36 rotating in the direction of the arrow J2 engages with the feeding roller gear 19 and the feeding roller gear 19 rotates in the direction of the arrow J1 and the control gear 24 rotates in the J2 direction. At this time, the feeding roller 11 rotates in the J1 direction the same as that in which the feeding roller gear 19 rotates. Further, as shown in FIG. 4, the feeding roller 11 rotates while abutting the separation roller 12 and the pressure plane 16 and releasing the abutting state, and therefore, the surface of the feeding roller 11 is cleaned. Then, in a case where the one rotational drive of the feeding roller 11 at S4 is completed, the processing advance to S5.

At S5, the MPU 201 adds 1 to the value of the i counter and determines whether the value after the addition is less than 10 (that is, whether the drive of the feeding roller 11 does not reach ten rotations). In a case where the determination results at this step are negative, it is regarded that the drive of the feeding roller 11 has reached ten rotations and the processing advances to S6. On the other hand, in a case where the determination results at this step are affirmative, it is regarded that the drive of the feeding roller 11 has not reached ten rotations and the processing returns to S4 and the processing at S4 to S5 is performed repeatedly until the drive of the feeding roller 11 reaches ten rotations.

At S6, the MPU 201 adds 1 to the value of the CountUP counter and determines whether the value after the addition is less than 3 (that is, whether the drive of the feeding roller 11 has not reached 30 rotations). In a case where the determination results at this step are negative, it is regarded that the drive of the feeding roller 11 has reached 30 rotations and the processing advances to S9. On the other hand, in a case where the determination results at this step are affirmative, it is regarded that the drive of the feeding roller 11 has not reached 30 rotations and the processing returns to S3 and the processing at S3 to S6 is performed repeatedly until the drive of the feeding roller 11 reaches 30 rotations.

In a case where it is determined that the value of the CountUP counter is not less than 3 at S6 (No at S6, that is, in a case where the drive of the feeding roller 11 has reached 30 rotations), at S9, the MPU 201 sets the value of the SNCLEAN flag to OFF. The processing at this step is performed by taking into consideration the state where the value of the SNCLEAN flag is set to ON as a result that the processing shown in FIG. 13, to be described later, has been performed.

At S10, the MPU 201 cuts off the transmission of the driving force to the feeding unit 4. Further, the MPU 201 drives the conveyance motor 61 and transmits the driving force from the conveyance motor gear 63 fixed to the conveyance motor 61 to the conveyance roller gear 62 fixed to one end of the conveyance roller 30 in order to bring the driving mechanism 8 into the first standby state. Then, the MPU 201 rotates the output gear 18 fixed to the other end of the conveyance roller 30 in the direction of the arrow J2 in FIG. 9C. At this time, as shown in FIG. 10D-1, the reverse rotation planetary gear 36 and the feeding roller gear 19 are in the engaged state. By the output gear 18 described previously rotating in the direction of the arrow J2 from this state, the driving force is transmitted from the output gear 18 to the idler gear 40 and the sun gear 37 and the sun gear 37 rotates in the direction of the arrow J2 in FIG. 10D-1. Because of this, the pendulum 39 rotates in the direction of the arrow M2 and the state where the reverse rotation planetary gear 36 is engaged with the feeding roller gear 19 is released. Then, in the state where the protruding portion 39*e* of the pendulum 39 abuts the stopper 41, the conveyance motor 61 is stopped and the first standby state shown in FIG. 9D is brought about. At this time, as shown in FIG. 9D, the reverse rotation planetary gear 36 stops in the state of being separate from the feeding roller gear 19 and the forward rotation planetary gear 35 stops in the state of being separate from the control gear 24. That is, the state (first standby state) is brought about where the drive connection from the conveyance motor 61 is cut off between the feeding roller gear 19 and the control gear 24.

After the series of processing shown in FIG. 12 is completed, the printing apparatus 1 enters a standby state of waiting for the instructions to start postprocessing to be performed after the feeding roller cleaning and in this standby state, a GUI screen OP7 is displayed on the operation panel 215.

The GUI screen OP7 has a message that leads a user to press down an OK button after stacking the three or more sheet materials 2 on the sheet stacking unit 6, and the OK button. In a case where the OK button on the GUI screen OP7 is pressed down by a user, a GUI screen OP8 including a message indicating that the postprocessing is being performed is displayed in place of the GUI screen OP7. The display of the GUI screen OP8 continues until the series of processing shown in FIG. 14 is completed.

In a case where the postprocessing shown in FIG. 14 is started, at S14, the MPU 201 performs the one rotational drive of the feeding roller 11. Specifically, first, the MPU 201 drives the conveyance motor 61. The driving force of the conveyance motor 61 is transmitted from the conveyance motor gear 63 fixed to the conveyance motor 61 to the conveyance roller gear 62 fixed to one end of the conveyance roller 30 and rotates the output gear 18 fixed to the other end of the conveyance roller 30 in the direction of the arrow J1 in FIG. 9C. Due to this, the driving force is transmitted from the output gear 18 to the idler gear 40 and the sun gear 37 and the sun gear 37 rotates in the direction of the arrow J1 in FIG. 9D, and therefore, the pendulum 39 rotates in the direction of the arrow M1. Then, the reverse rotation planetary gear 36 rotating in the direction of the arrow J2 engages with the feeding roller gear 19 and the feeding roller gear 19 rotates in the direction of the arrow J1 and the control gear 24 rotates in the J2 direction. At this time, the feeding roller 11 rotates in the direction of the arrow J1 the same as that in which the feeding roller gear 19 rotates.

Then, conveyance-amount control of the sheet material 2 by the feeding roller 11 is performed by using a PE sensor signal, not shown schematically, which detects the tip position of the sheet material 2, and after the tip of the sheet material 2 abuts the conveyance roller 30, the drive is performed until the sheet material 2 is conveyed 3 mm further. At this time, the conveyance roller 30 is rotating in the direction of the arrow J1 in FIG. 9C together with the output gear 18, and therefore, the sheet material 2 enters the state of being pushed into the nip portion without passing the nip portion of the conveyance roller 30 and the follower roller 29. Because of this, the state is brought about where the tip of the sheet material 2 reaches the conveyance roller 30 and so-called registration is performed. This state is the state in the vicinity of P2 shown in FIG. 4.

From this state, the drive of the conveyance motor 61 is performed in the direction opposite to the previous direction and the pivot regulation of the pendulum 39 is released by moving the stopper 41 by a moving unit, not shown schematically, as well as rotating the conveyance roller 30 in the direction of the arrow J2 in FIG. 10C. Due to this, the stopper 41 retracts from the state in FIG. 10D-1. Further, the sun gear 37 rotates in the direction of the arrow J2 in FIG. 10D-1, and therefore, the pendulum 39 rotates in the direction of the arrow M2. Then, the forward rotation planetary gear 35 rotating in the direction of the arrow J1 in FIG. 10D-2 engages with the control gear 24 and the control gear 24 begins to rotate in the J2 direction. Further, the feeding roller gear 19 rotates in the direction of the arrow J1 in FIG. 10D-2 and due to this, the feeding roller 11 also rotates in the J1 direction.

At this time, the tip of the sheet material 2 has reached the position of the nip portion of the conveyance roller 30 and the follower roller 29, and therefore, the conveyance of the sheet material 2 is performed as well as the rotation of the conveyance roller 30 in the direction of the arrow J2 in FIG. 10C. At this time, the sun gear 37 is rotating in the direction of the arrow J2 in FIG. 10D-2, and therefore, the pendulum 39 rotates in the direction of the arrow M2. Then, the forward rotation planetary gear 35 rotating in the direction of the arrow J1 in FIG. 10D-2 engages with the control gear 24 and the control gear 24 rotates in the direction of the arrow J2 together with the control cam 34. Due to this, the feeding roller gear 19 rotates in the direction of the arrow J1 together with the feeding roller 11. At this time, the control gear 24 and the control cam 34 are driven until the forward rotation planetary gear 35 reaches the first toothless section 51 of the control gear 24. Further, at the same time the drive of the control gear 24 and the control cam 34 stops, the drive of the feeding roller gear 19 and the feeding roller 11 also stops and the state of the feeding unit 4 becomes the same state as the first standby state except for the stopper 41 and the pendulum 39. At this time, the drive that brings the stopper 41 and the pendulum 39 into the same state as the first standby state is not performed in a case where the instructions to feed the next sheet material 2 are recognized by the MPU 201.

At S15 after S14, the MPU 201 further continues the drive of the conveyance motor 61 and drives the conveyance roller 30 in the direction of the arrow J2 in FIG. 9C. Due to this, the discharge roller 31 also performs the drive in the same direction, and therefore, the conveyance and discharge of the sheet material 2 are performed. Accompanying the discharge of the sheet material 2, the debris and stain that adhere to the sheet material 2 from the surface of the feeding roller 11 and the separation roller 12 are removed together with the discharged sheet material 2. Further, after the water wipe is performed for the feeding roller 11, to be described later, the moisture having adhered to the feeding roller 11 and the separation roller 12 is also removed together with the sheet material 2.

At S16, the MPU 201 determines whether the sheet material 2 is no longer fed from the sheet stacking unit 6. As described previously, in the present embodiment, two or three sheet materials are set on the sheet stacking unit 6 for postprocessing, and therefore, at this step, whether the discharging operation for three sheet materials has been performed from the feeding of the sheet material 2 is determined. In a case where the determination results at this step are affirmative, the postprocessing is completed. On the other hand, in a case where the determination results at this step are negative, the processing returns to S14 and the processing at S14 to S16 is performed repeatedly until the sheet material 2 is no longer fed from the sheet stacking unit 6.

In a case where the postprocessing shown in FIG. 14 is completed, a GUI screen OP9 is displayed in place of the GUI screen OP8. The GUI screen OP9 has a message that prompts a user to press an OK button because the entire cleaning processing of the feeding roller 11 including the postprocessing is completed, and the OK button. In a case where a user presses down the OK button on the GUI screen OP9, the GUI screen OP1 is displayed again in place of the GUI screen OP9.

Next, a case where the "With water wipe" instruction item is selected on the GUI screen OP4 (that is, in a case where water-wipe cleaning is performed) is explained by using FIG. 13 to FIG. 15. In a case where the "With water wipe" instruction item on the GUI screen OP4 is selected by a user, the GUI screen OP5 is displayed in place of the GUI screen OP4. The GUI screen OP5 has a message that leads a user to remove all the sheet materials 2 stacked on the sheet stacking unit 6 and press down an OK button, and the OK button. In a case where the OK button on the GUI screen OP5 is pressed down, a GUI screen OP10 is displayed in place of the GUI screen OP5. In a case where an OK button on the GUI screen OP10 is pressed down by a user, processing that is performed before the water-wipe cleaning of the feeding roller 11 (in the present specification, simply called preprocessing or the like) shown in FIG. 13 is started.

The GUI screen OP10 has a message that leads a user to perform the water wipe of the feeding roller 11 after turning off the electric power source of the printing apparatus 1 (after bringing the printing apparatus 1 into the electric power source OFF state), and the OK button. In a case where the OK button on the GUI screen OP10 is pressed down by a user, a GUI screen OP11 is displayed in place of the GUI screen OP10 and the printing apparatus 1 enters the state of waiting for the electric power source turning OFF processing and the preprocessing shown in FIG. 13 is started. This preprocessing is processing to switch the standby states of the separation feeding mechanism 7 (in the present specification, called standby state switching processing, switching processing, and the like).

At S11, the MPU 201 drives the conveyance motor 61. The driving force of the conveyance motor 61 is transmitted from the conveyance motor gear 63 fixed to the conveyance motor 61 to the conveyance roller gear 62 fixed to one end of the conveyance roller 30 and rotates the output gear 18 fixed to the other end of the conveyance roller 30 in the direction of the arrow J1 in FIG. 9C. Due to this, the driving force is transmitted from the output gear 18 to the idler gear 40 and the sun gear 37 and the sun gear 37 rotates in the direction of the arrow J1 in FIG. 9D, and therefore, the pendulum 39 rotates in the direction of the arrow M1. Then, the reverse rotation planetary gear 36 rotating in the direction of the arrow J2 engages with the feeding roller gear 19 and the feeding roller gear 19 rotates in the direction of the arrow J1 and the control gear 24 rotates in the J2 direction. After that, the feeding roller 11 rotates in the direction of the arrow J1 together with the feeding roller gear 19 and the MPU 201 stops the drive of the conveyance motor 61 in the state shown in FIG. 10D-1.

As shown in FIG. 10E, this state is a state where at the portion facing the feeding roller gear 19, the third toothless section 52*b* of the control gear 24 is located. Consequently, the state is such that the feeding roller gear 19 does not engage with the control gear 24 and the transmission of the driving force is shut off between the feeding roller gear 19 and the control gear 24.

At S12, the MPU 201 updates the value of the SNCLEAN flag stored in the RAM 203, specifically, sets the value to ON. Here, the value of the SNCLEAN flag stored in the RAM 203 is set so that the value is not deleted even in a case where the electric power source of the main body of the printing apparatus 1 is turned OFF. The processing at this step is performed for storing information relating to a history indicating whether or not the processing to switch the standby states of the separation mechanism 7 has been performed. It may also be possible to store the value of the SNCLEAN flag in the ROM 202.

At S13, the MPU 201 stops the drive of the feeding roller 11 and brings about the second standby state. Specifically, the MPU 201 rotates the sun gear 37 in the direction of the arrow J2 in FIG. 10D-1 by driving the conveyance motor 61 from the state shown in FIG. 10D-1 and stops the sun gear 37 in the state where the protruding portion 39*e* of the pendulum 39 abuts the stopper 41. Due to this, the reverse rotation planetary gear 36 stops in the state of being separate from the feeding roller gear 19 and the forward rotation planetary gear 35 stops in the state of being separate from the control gear 24. That is, a state is brought about where the separating force of the separation roller 12 does not occur, the feeding roller 11 and the separation roller 12 abut each other, and the drive connection (that is, transmission of driving force between the conveyance motor 61, which is a driving source, and the feeding roller 11) is shut off between the feeding roller gear 19 and the control gear 24. In the present specification, the state such as this is called the second standby state.

At this time, as shown in FIG. 10E, the state is such that at the portion facing the feeding roller gear 19, the third toothless section 52*b* of the control gear 24 is located. Consequently, the state is such that the feeding roller gear 19 does not engage with the control gear 24 and the control gear 24 is not rotated. Further, the state is such that the separation roller 12 is in the state of being in pressure contact with the feeding roller 11 and the protruding portion 23*a* of the lock lever 23 disengages from the gear portion 12*d* of the clutch axis 12 and the clutch axis 12*b* enters the free state, and the torque of the separation roller 12 does not occur. Because of this, the state is such that the separation roller 12 is a so-called follower roller of the feeding roller 11 and at the same time, the driving force to the feeding roller gear 19 is shut off, and therefore, it is made possible for a user to easily rotate the feed axis 10 of the feeding roller 11 manually. Further, the state is such that it is also possible to easily rotate the separation roller 12 that is a follower roller of the feeding roller 11 by rotating the feed axis 10 to cause the separation roller 12 to follow the feeding roller 11.

In a case where the processing at S13 is completed and the preprocessing is completed, the electric power source of the main body of the printing apparatus 1 turns OFF, and as shown by symbol OP 12 in FIG. 15, nothing is displayed on the operation panel 215.

In this state, a user rotates the feed axis 10 while applying a damp cloth or the like to the surface of the feeding roller 11. Then, on the surface of the feeding roller 11 including moisture, the surface of the separation roller 12 is also given a water wipe. Then, the stain of the separation roller 12 wiped by the feeding roller 11 is removed again by a water wipe with a cloth or the like. Consequently, it is possible for a user to clean the feeding roller 11 and the separation roller 12.

In a case where the cleaning by a water wipe of the feeding roller 11 and the separation roller 12 is completed, a user is caused to turn ON the electric power source of the main body of the printing apparatus 1. Due to this, the printing apparatus 1 enters the state where the GUI screen OP1 is displayed on the operation panel 215. At this time, the feeding unit 4 is not in the first standby state, and therefore, the MPU 201 drives the conveyance motor 61 until the state of P1 in FIG. 4 is brought about. Further, for the postprocessing of the water-wipe cleaning, the MPU 201 functions as a display control unit and displays the GUI screens OP1 to OP3 on the operation panel 215. A user who has viewed the GUI screens OP1 to OP3 performs the same processing as the processing described previously in order to clean the feeding roller 11 in accordance with manual instructions.

After that, in a case where the "Without water wipe" instruction item on the GUI screen OP4 that is displayed following the GUI screen OP3 is selected by a user, the GUI screen OP5 is displayed in place of the GUI screen OP4. A user who has viewed the GUI screen OP5, as in the case described previously, removes all the sheet materials 2 stacked on the sheet stacking unit 6 and presses down the OK button.

In a case where the OK button on the GUI screen OP5 is pressed down by a user, the GUI screen OP6 is displayed in place of the GUI screen OP5 and the without-water-wipe cleaning processing of the feeding roller 11 (called without-water-pipe roller cleaning processing or the like) shown in FIG. 12 is started. The display of the GUI screen OP6 continues until the series of processing shown in FIG. 12 is completed. At S1 in FIG. 12, the MPU 201 determines whether the value of the SNCLEAN flag is ON. In the case of this time, the preprocessing has been performed and the SNCLEAN flag value is ON (S12 in FIG. 13), and therefore, the determination results at S1 are affirmative. Consequently, after S1, the processing advances to S7.

At S7, the MPU 201 sets the value of the CountUP counter to 2. Further, next at S8, the MPU 201 sets the value of the i counter to 5. The reason the values of the counters are set in this manner is that the number of times of rotation of the feeding roller 11 is reduced compared to that in a case where the water wipe is not performed because the roller cleaning processing shown in FIG. 12 is performed as the postprocessing of the roller cleaning with a water wipe.

After S8, as in the case described previously, at S4, the MPU 201 performs the one rotational drive of the feeding roller 11 and at S5, adds 1 to the value of the i counter, and determines whether the value after the addition is less than 10. However, in the case of this time, the value of the i counter is set to 5 at S8, and therefore, after the one rotational drive of the feeding roller 11 is performed once, the value of the i counter is 6. Further, until it is determined that the value of the i counter has reached 10 by the determination at S5, the processing at S4 to S5 is repeated, and therefore, in a case where the number of rotations of the feeding roller 11 reaches 5, the determination results at S5 are negative, and therefore, the processing advances to S6.

At S6, the MPU 201 adds 1 to the value of the CountUP counter and determines whether the value after the addition is less than 3. In the case of this time, the value of the CountUP counter is set to 2 at S7, and therefore, in a case where the number of rotations of the feeding roller 11 reaches 5, the value of the CountUP counter is 3, and therefore, the determination results at S6 are negative and the processing advances to S9. Then, as in the case described previously, the processing at S9 to S10 and S14 to S16 is performed and at the same time, the GUI screens OP7 to OP9 are displayed in order and the entire cleaning processing of the feeding roller is completed.

As explained above, in the present embodiment, as the standby state of the feeding unit 4, the first standby state and the second standby state are provided. Due to this, it is possible to bring about the state where the feeding roller axis 10 can be rotated easily with hand, and therefore, it is made possible to easily perform the with-water-wipe cleaning of the feeding roller 11 and the separation roller 12.

Further, in the present embodiment, the SNCLEAN flag is provided and the control to store that the feeding unit 4 is brought into the second standby state is performed. Due to this, it is made possible to perform the unique postprocessing after performing the with-water-wipe cleaning of the feeding roller 11, and therefore, it is made possible to reduce the number of times of the without-water-wipe cleaning. Consequently, usability is improved.

Second Embodiment

In the first embodiment, as the postprocessing after the cleaning of the feeding roller 11, after the electric power source is turned ON and after the operation in which the number of times of rotation of the feeding roller 11 in the without-water-wipe cleaning processing is changed is performed, the processing common to cleaning with a water wipe and cleaning without a water wipe is performed (see FIG. 12, FIG. 14).

In the present embodiment, the MPU 201 acquires the SNCLEAN flag value at the time of turning ON the electric power source and determines whether the SNCLEAN flag value is ON. Then, in a case where the determination results are affirmative, it may also be possible to omit the display processing of the GUI screens OP1 to OP4 and perform the same processing as the postprocessing after the water wipe described previously from the state where the GUI screen OP5 (see FIG. 15) is displayed. Alternatively, it may also be possible not to perform the rotation of the feeding roller 11 by the without-water-wipe cleaning in accordance with the performance of the rubber of the feeding roller 11 of the printing apparatus after the cleaning with a water wipe of the feeding roller 11 and start from the state where the GUI screen OP7 is displayed after turning ON the electric power source.

Third Embodiment

In the first embodiment, as the configuration for shutting off the driving force that is transmitted to the control gear 24 in a case where the feeding roller axis 10 is rotated, the third toothless section 52*b* in the control gear 34 is provided. Further, as the configuration for shutting off the driving force from the conveyance motor 61, which is a driving source, the configuration is shown in which the reverse rotation planetary gear 36 is separated from the feeding roller gear 19.

In the following, a shut-off configuration to shut off the driving force on the feeding roller axis in a case where the feeding roller axis is rotated in the present embodiment is explained by using FIG. 16A to FIG. 16C.

Figure 16A:
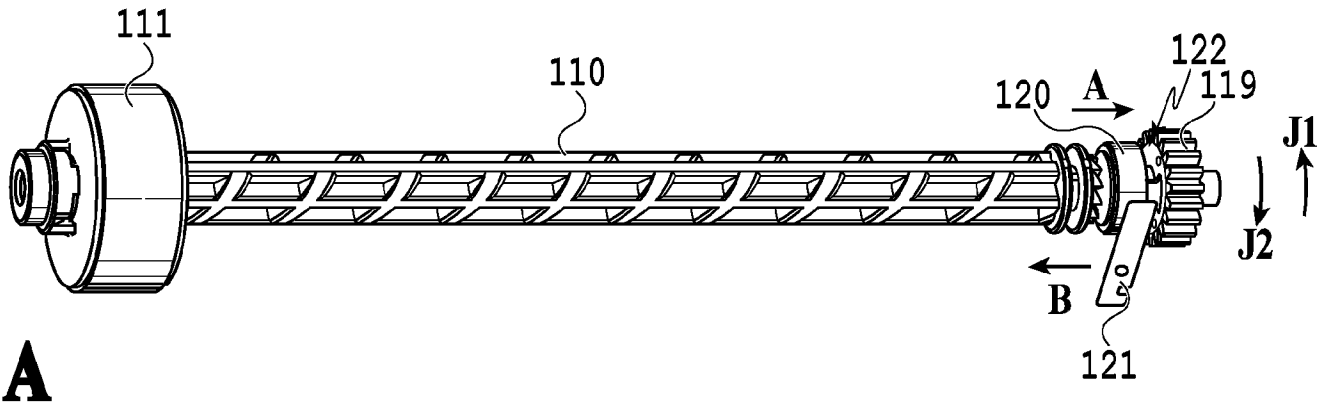
FIG. 16A to FIG. 16C are each a perspective diagram of a feeding roller unit in a third embodiment.

As shown in FIG. 16A, the feeding roller unit in the present embodiment has a feeding roller 111, a feeding roller axis 110, a feeding roller gear 119, a serrate gear 120, and a serrate gear spring 121.

Figure 16B:
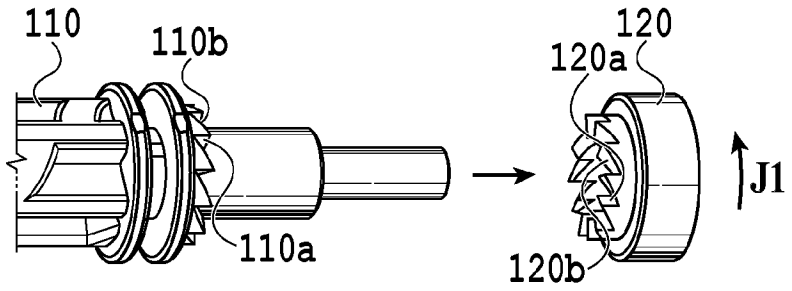
Figure 16C:
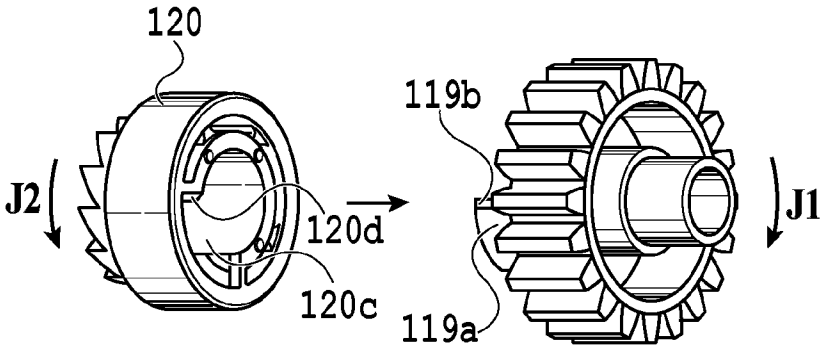

As shown in FIG. 16B, at one end of the feeding roller axis 110, a substantially vertical surface 110*a* is provided. This substantially vertical surface 110*a* is a surface for transmitting the rotary force of a substantially vertical surface 120*a* of the serrate gear 120 in a case where the feeding roller gear 119 is rotated in a direction of an arrow J1 in FIG. 16B. Further, at one end of the feeding roller axis 110, an inclined surface 110*b* is provided. This inclined surface 110*b* is a surface for transmitting the rotary force to an inclined surface 120*b* of the serrate gear 120 in a case where the feeding roller axis 110 is rotated in the direction of the arrow J1 in FIG. 16B.

The serrate gear 120 is biased to the feeding roller axis 110 by the serrate gear spring 121. Further, the feeding roller gear 119 is provided with a protruding portion 119*a* and the protruding portion 119*a* enters a concave portion 120*c* of the serrate gear 120 and an operation surface 119*b* of the feeding roller gear 119 pushes a surface to be operated 120*d* of the serrate gear 120. Due to this, the serrate gear 120 rotates in the same direction as that in which the feeding roller gear 119 rotates. At this time, the surface to be operated 120*d* of the serrate gear 120 is inclined and the configuration is such that in a case of receiving a force in a direction of an arrow J1 in FIG. 16C of the feeding roller gear 120, the surface to be operated 120 receives a moving force in a direction of an arrow B in FIG. 16A.

Further, between the serrate gear 120 and the feeding roller gear 119, a space 122 is provided. This space 122 is a space for the serrate gear 120 to move in a direction of an arrow A in FIG. 16A and for the engagement between the inclined surface 110*b* of the feeding roller axis 110 and the inclined surface 120*b* of the serrate gear 120 to be released in a case where the feeding roller axis 110 is rotated in the direction of the arrow J1 in FIG. 16A.

The feeding roller 111 in the present embodiment has the configuration as described above. Consequently, in a case where the feeding roller axis 110 is rotated in the direction of the arrow J1 in FIG. 16A, the serrate gear 120 moves in the direction of the arrow A and the engagement of the inclined surface 110*b* of the feeding roller axis 110 and the inclined surface 120*b* of the serrate gear 120 is released. As a result of this, the transmission of the driving force on the feeding roller axis 110 is shut off on the feeding roller axis 110. At this time, at a second standby position, the separation roller 12 is in the state of being in pressure contact with the feeding roller 111 and the protruding portion 23*a* of the lock lever 23 disengages from the gear portion 12*d* of the clutch 12 and the clutch 12*b* enters the free state, and the state is such that the torque of the separation roller 12 does not occur.

As explained above, in the present embodiment also, it is possible to obtain the same effects as those in the first embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to one embodiment of the present invention, it is made possible to provide a printing apparatus in which the surface of a feeding roller and a separation roller can be cleaned easily by using a damp cloth or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026170, filed Feb. 19, 2020, which is hereby incorporated by reference herein in its entirety.

What is claimed is:

1. A printing apparatus comprising:

a feeding roller that feeds a printing medium;

a separation roller capable of selectively taking a first state where a separating force that separates a plurality of printing media conveyed by the feeding roller one by one occurs and a second state where the separating force does not occur at a position at which the separation roller is in pressure contact with the feeding roller;

a control unit configured to perform control to bring about, in a case that transmission of a driving force between a driving source of the feeding roller and the feeding roller is shut off while the feeding roller and the separation roller abut each other, a first standby state where the separation roller is in the first state, and a second standby state where the separation roller is in the second state, the first standby state being a state in which the feeding roller and the separation roller are in contact; and a display control unit configured to select from among the first standby state and the second standby state using an operation panel.

2. The printing apparatus according to claim 1, wherein the display control unit causes the operation panel to display a GUI for a user to select which of without-water-wipe automatic cleaning in the second standby state and with-water-wipe manual cleaning in the first standby state to perform.

3. The printing apparatus according to claim 2, further comprising:

a storage unit configured to store a flag value indicating whether or not processing to switch the second standby state to the first standby state has been performed, wherein in a case where the manual cleaning is selected by a user, as preprocessing of the manual cleaning, control to bring about the first standby state by the control unit and updating of the flag value are performed.

4. The printing apparatus according to claim 3, wherein after control to bring about the first standby state by the control unit is performed, electric power source turning OFF processing is performed, and after the electric power source turning OFF processing is performed, in a case where a user manually rotates a rotation axis of the feeding roller, the separation roller also rotates together with the feeding roller.

5. The printing apparatus according to claim 4, further comprising:

a determination unit configured to determine whether the flag value is ON at the time of turning ON the electric power source, wherein in a case where determination results of the determination unit are affirmative, cleaning processing is performed, and in a case where the determination results are negative, part of processing that is to be performed is omitted.

6. The printing apparatus according to claim 5, wherein a number of times the feeding roller is rotated in cleaning processing that is performed after the manual cleaning in a case where determination results of the determination unit are affirmative is less than a number of times the feeding roller is rotated in cleaning processing that is performed in a case where the determination results are negative.

7. The printing apparatus according to claim 1, further comprising:

a shutting-off unit configured to shut off transmission of the driving force from the driving source to the feeding roller.

8. The printing apparatus according to claim 7, wherein the shutting-off unit includes a reverse rotation planetary gear and a feeding roller gear, and transmission of the driving force from the driving source to the feeding roller is shut off by the reverse rotation planetary gear separating from the feeding roller gear.

9. The printing apparatus according to claim 7, wherein the shutting-off unit includes a feeding roller axis having a first inclined surface and a serrate gear having a second inclined surface, and transmission of a driving force from the driving source to the feeding roller is shut off by engagement of the first inclined surface and the second inclined surface being released in a case where the feeding roller axis is rotated in a direction in which a printing medium moves onward in a conveyance direction.

10. The printing apparatus according to claim 1, further comprising:

a stacking unit configured to stack one or a plurality of printing media; and a print head that is provided on a downstream side of the separation roller in a conveyance direction of a printing medium and which performs printing on a printing medium.

11. The printing apparatus according to claim 1, further comprising:

a transmission gear configured to transmit the driving force to the feeding roller; and a planetary gear configured to move to a position engaging the transmission gear and a position separate from the transmission gear, wherein in the second standby state, the planetary gear is in the position separate from the transmission gear.

12. The printing apparatus according to claim 1, further comprising:

a feeding roller gear attached to a rotation axis of the feeding roller; and a transmission gear including a toothless portion and configured to transmit the driving force to the feeding roller gear, wherein in the first standby state, the transmission gear is not engaged with the feeding roller gear due to the toothless portion.

13. A control method of a printing apparatus comprising:

a feeding roller that feeds a printing medium; and a separation roller capable of selectively taking a first state where a separating force that separates a plurality of printing media conveyed by the feeding roller one by one occurs and a second state where the separating force does not occur at a position at which the separation roller is in pressure contact with the feeding roller, the control method comprising:

a step of bringing about, in a case that transmission of a driving force between a driving source of the feeding roller and the feeding roller is shut off while the feeding roller and the separation roller abut each other, a first standby state where the separation roller is in the first state and a second standby state where the separation roller is in the second state, the first standby state being a state in which the feeding roller and separation roller are in contact; and selecting from among the first standby state and the second standby state using an operation panel.

14. The method according to claim 13, further comprising:

a step of causing the operation panel to display a GUI for a user to select which of without-water-wipe automatic cleaning in the second standby state and with-water-wipe manual cleaning in the first standby state to perform.

15. The method according to claim 14, further comprising:

a step of storing a flag value indicating whether or not processing to switch the second standby state to the first standby state has been performed, wherein in a case where the manual cleaning is selected by a user, as preprocessing of the manual cleaning, control to bring about the first standby state and updating of the flag value are performed.

16. The method according to claim 15, further comprising:

after control to bring about the first standby state is performed, performing electric power source turning OFF processing, and after the electric power source turning OFF processing is performed, in a case where a user manually rotates a rotation axis of the feeding roller, controlling the separation roller also to rotate together with the feeding roller.

17. The method according to claim 13, wherein the printing apparatus further comprises:

a transmission gear configured to transmit the driving force to the feeding roller; and a planetary gear configured to move to a position engaging the transmission gear and a position separate from the transmission gear, wherein in the second standby state, the planetary gear is in the position separate from the transmission gear.

18. The method according to claim 13, wherein the printing apparatus further comprises:

a feeding roller gear attached to a rotation axis of the feeding roller; and a transmission gear including a toothless portion and configured to transmit the driving force to the feeding roller gear, wherein in the first standby state, the transmission gear is not engaged with the feeding roller gear due to the toothless portion.

* * * * *